US006739320B2

(12) United States Patent
Ito et al.

(10) Patent No.: US 6,739,320 B2
(45) Date of Patent: May 25, 2004

(54) EVAPORATIVE FUEL PROCESSING SYSTEM FOR IN-CYLINDER FUEL INJECTION TYPE INTERNAL COMBUSTION ENGINE AND METHOD

(75) Inventors: Yukikazu Ito, Nishikamo-gun (JP); Kiyoo Hirose, Nagoya (JP); Koji Honda, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/417,130

(22) Filed: Apr. 17, 2003

(65) Prior Publication Data

US 2003/0200958 A1 Oct. 30, 2003

(30) Foreign Application Priority Data

Apr. 26, 2002 (JP) ..... 2002-163576

(51) Int. Cl.[7] ..... F02D 4/00
(52) U.S. Cl. ..... 123/674; 123/520
(58) Field of Search ..... 123/674, 672, 123/681, 520

(56) References Cited

U.S. PATENT DOCUMENTS 5,299,546 A * 4/1994 Kato et al. ..... 123/520
5,979,419 A * 11/1999 Toyoda ..... 123/520

FOREIGN PATENT DOCUMENTS

JP 2001-152931 A 6/2001

* cited by examiner

*Primary Examiner*—Bibhu Mohanty
(74) *Attorney, Agent, or Firm*—Kenyon & Kenyon

(57) ABSTRACT

An evaporative fuel processing system for an in-cylinder injection type internal combustion engine includes an evaporative fuel processing mechanism that includes a canister to which an evaporative fuel in a fuel supply system is adsorbed and performs an operation for purging the adsorbed evaporative fuel into an intake system of the internal combustion engine. The system further includes a controller that estimates a degree of dilution occurred in a lubricating oil for the internal combustion engine with a fuel mixed therewith, and inhibits the purging operation performed by the evaporative fuel processing mechanism when the estimated degree of dilution is equal to or larger than a predetermined value.

19 Claims, 10 Drawing Sheets

EVAPORATIVE FUEL PROCESSING SYSTEM FOR IN-CYLINDER FUEL INJECTION TYPE INTERNAL COMBUSTION ENGINE AND METHOD

The disclosure of Japanese Patent Application No. 2002-163576 filed on Apr. 26, 2002, including the specification, drawings and abstract are incorporated herein by reference in its entirety.

BACKGROUND OF THE INVENTION

1. Field of Invention

The invention relates to an evaporative fuel processing system for an in-cylinder fuel injection type internal combustion engine, in which an evaporative fuel processing mechanism is provided for purging the evaporative fuel in a fuel supply system to an intake system and an evaporative fuel processing method. More specifically, the invention relates to an evaporative fuel processing system and method for controlling a flow rate of the evaporative fuel to be purged to the intake system by the evaporative fuel processing mechanism in accordance with an air/fuel ratio of the internal combustion engine.

2. Description of Related Art

Generally in an internal combustion engine, an evaporative fuel generated in a fuel supply system such as a fuel tank is temporarily adsorbed in a canister. The adsorbed evaporative fuel is introduced as purge gas to the intake system at a predetermined timing so as to be treated or purged. As the purge gas has a high fuel content, the air/fuel ratio may fluctuate if the quantity of the purge gas is not appropriately controlled.

In JP-A 2001-152931, a variance tendency of an actual air/fuel ratio with respect to a target air/fuel ratio, which is obtained by an air/fuel ratio feedback control is monitored so as to learn the fuel concentration of the purge gas (purge concentration) on the basis of the monitored variance tendency. The flow rate of the purge gas is controlled in accordance with the purge concentration such that appropriate quantity of the purge gas in accordance with the operating state of the engine is introduced into the intake system.

The internal combustion engine is provided with a crankcase emission control system for treating gas that leaks out of the cylinder to the crankcase, that is, blowby gas having strong acidity that may cause rust on a metal part of the engine body or deteriorate the lubricating oil therein. The crankcase emission control system introduces new air from outside (through air cleaner provided in the intake system) into the engine body, and circulates the introduced air within the crankcase so as to be returned to the intake system. Implementing the aforementioned scavenging process makes it possible to treat the blowby gas without being discharged to the outside.

Returning the blowby gas containing uncombusted fuel to the intake system may substantially fluctuate the fuel injection quantity. Normally, however, the uncombusted fuel concentration of the blowby gas is not so high nor largely fluctuates. Therefore, an air/fuel ratio feedback control is performed to cope with the fluctuation of the fuel injection quantity so as to restrain the adverse effect resulting from such fluctuation.

Unlike the internal combustion engine using the intake port, in the in-cylinder fuel injection type internal combustion engine where the fuel is directly injected into the cylinder from the fuel injection valve, the distance between the nozzle hole of the fuel injection valve and the inner peripheral surface of the cylinder is so short that the injected fuel directly impinges on the inner peripheral surface. The aforementioned type of the internal combustion engine may cause problems as described below.

In the above type of the internal combustion engine in the cold state, it is difficult to promote atomization of the fuel in the cylinder, and as a result, the injected fuel is partially kept uncombusted and adhered to the inner peripheral surface of the cylinder. The adhered fuel is mixed with the lubricating oil applied on the inner peripheral surface of the cylinder for lubrication. Accordingly, the lubricating oil is diluted with the fuel.

The lubricating oil that has been diluted with the fuel is peeled off from the inner peripheral surface of the cylinder as the piston reciprocates, and returned to a crankcase (more particularly, an oil pan formed in the crankcase) so as to be used for lubricating the piston and the like in the internal combustion engine. If the aforementioned dilution of the lubricating oil frequently occurs, the quantity of the fuel to be mixed with the lubricating oil in the crankcase, that is, the whole lubricating oil supplied for lubricating the internal combustion engine may gradually increase.

As the fuel content in the lubricating oil increases, a large quantity of the fuel evaporates from the lubricating oil. This may considerably raise the fuel concentration in the blowby gas. If the aforementioned blowby gas with increased fuel concentration is introduced in the intake system, the variance tendency of the actual air/fuel ratio with respect to the target air/fuel ratio largely fluctuates. If the purge concentration is learned in the aforementioned case, however, it may be mistakenly determined that the fluctuation of the air/fuel ratio variance tendency has been caused by the change in the purge concentration.

The adverse effect resulting from the aforementioned error in learning of the purge concentration is more likely to occur in the engine operation at low load where the flow rate of the purge gas is set to a small value. Therefore, if the engine operation is rapidly brought into the transient stage from the low load where it is likely to be adversely affected by the error in the learning to the high load where it is less likely to be adversely affected by the error, the purge concentration varies as if it were caused by the change in the load state. As a result, fluctuation of the air/fuel ratio during such transient operation of the engine inevitably occurs.

SUMMARY OF THE INVENTION

It is an object of the invention to provide an evaporative fuel processing system for an in-cylinder fuel injection type internal combustion engine to restrain fluctuation of the air/fuel ratio of the engine at the transient operation stage, which is caused by an adverse influence of dilution of the lubricating oil with fuel to purging control, especially, the error in learning of the purge concentration.

According to an embodiment of the invention, an evaporative fuel processing system for an in-cylinder injection type internal combustion engine includes an evaporative fuel processing mechanism that includes a canister to which an evaporative fuel in a fuel supply system is adsorbed and performs an operation for purging the adsorbed evaporative fuel into an intake system of the internal combustion engine. The system further includes a controller that estimates a degree of dilution occurred in a lubricating oil for the internal combustion engine with a fuel mixed therewith, and inhibits the purging operation performed by the evaporative fuel processing mechanism when the estimated degree of dilution is equal to or larger than a predetermined value.

In the aforementioned embodiment, the degree of dilution of the lubricating oil with the fuel is estimated. The purging performed by the evaporative fuel processing mechanism is inhibited if the estimated degree of dilution is higher than a predetermined level. This makes it possible to prevent the error in learning of purge concentration even if the fuel evaporating from the lubricating oil is introduced into the intake system. This may restrain fluctuation of the air/fuel ratio of the engine at the transient operation stage, which is caused by the adverse influence of the dilution of the lubricating oil with the fuel to the purge control, especially, the error in learning of the purge concentration.

In the case where quantity of the evaporative fuel from the lubricating oil is increasing, it is likely that the actual air/fuel ratio shows a variance tendency from the target air/fuel ratio to the fuel rich side. Meanwhile, it is unlikely that the actual air/fuel ratio shows a variance tendency from the target air/fuel ratio to the fuel lean state. Even if an air/fuel ratio correction amount derived from the aforementioned variance tendency is increasing (the variance from the reference value of the air/fuel correction amount is large), the air/fuel correction amount is increased to compensate the air/fuel ratio to the fuel rich side so far as it is caused by the increasing quantity of the evaporative fuel from the lubricating oil. Conversely, in the case where the air/fuel ratio correction amount is increasing to compensate the air/fuel ratio to the fuel lean state, such increase in the correction amount is considered to be caused by the reason other than the increase in the evaporative fuel quantity.

According to the embodiment of the invention, the controller inhibits the purging operation when the estimated degree of dilution is equal to or larger than the predetermined value, and an air/fuel ratio correction amount of an air/fuel ratio feedback control obtained in accordance with a variance tendency of an actual air/fuel ratio with respect to a target air/fuel ratio increases by a predetermined amount or more so as to compensate the actual air/fuel ratio to a fuel rich side with respect to the target air/fuel ratio.

In the aforementioned embodiment, performance of purging is inhibited if the estimated degree of dilution is higher than the predetermined level, and the air/fuel ratio correction amount is increasing by a predetermined amount so as to compensate the air/fuel ratio to the fuel rich side. When the evaporative fuel quantity is increased by the dilution of the lubricating oil, and the resultant air/fuel ratio variance occurs, performance of purging is inhibited. In the state where the estimated degree of dilution is higher than the predetermined level and the air/fuel ratio correction amount shows the value to compensate the air/fuel ratio to the fuel lean state, performance of purging is not inhibited. That is, even if the degree of dilution is in relatively high level, performance of purging is not inhibited so far as it is determined that no learning error occurs. This makes it possible to avoid unnecessary inhibition of performance of purging.

According to the embodiment of the invention, the controller estimates the degree of dilution on the basis of a historical record of an operation of the internal combustion engine. The degree of dilution of the lubricating oil varies with the historical record of operation of the internal combustion engine. For example, if the cold short-trip is repeatedly performed, that is, the cycle in which the internal combustion engine is started at a low temperature of the engine, and stopped before the engine temperature sufficiently rises up is repeatedly implemented, the degree of dilution of the lubricating oil with the fuel greatly increases. Meanwhile, if the internal combustion engine is continuously operated for an extended period of time even after completion of the warming-up, the degree of dilution decreases as the fuel contained in the lubricating oil gradually evaporates. As a result, the degree of dilution of the lubricating oil may be estimated by referring to the historical record of the operation of the internal combustion engine.

More specifically, the controller monitors the operation of the internal combustion engine in a state where the degree of dilution is increasing and estimates the degree of dilution on the basis of a result of monitoring the operation. Therefore the degree of dilution may be accurately estimated under the condition where it is increasing.

When the temperature of the engine at start-up is high, it is not likely that the fuel adheres to the inner peripheral surface of the cylinder. Accordingly, no increase in the degree of dilution of the lubricating oil with the fuel occurs. It is possible to determine that the internal combustion engine is operated under the condition where the degree of dilution is increasing if the temperature of the engine at start-up that has been monitored is equal to or lower than a predetermined temperature.

Even when the temperature of the engine at the start-up is relatively low, adhesion of the fuel to the inner peripheral surface of the cylinder may be restrained by continuously operating the internal combustion engine for an extended period of time. As the combustion heat generated in the cylinder increases the temperature of the lubricating oil, quantity of the evaporative fuel from the lubricating oil increases.

In the case where the time elapsing from the start to stop of the internal combustion engine becomes long, the degree of dilution may temporarily increase owing to dilution at the earlier operation stage of the engine, but gradually decrease thereafter as the fuel evaporates from the lubricating oil during subsequent operation of the engine continuously. Such decrease in the degree of dilution may offset or exceeds the increase in the degree of dilution generated at the earlier operation stage of the engine. Therefore the historical record of the engine operation under the condition where the degree of dilution is increasing is no longer necessary.

In the aforementioned embodiment, the time elapsing from start to stop of the engine is measured. It is possible to determine that the internal combustion engine has been operated under the condition where the degree of dilution is increasing if the engine temperature at start-up is equal to or lower than the predetermined temperature, and the measured time is equal to or shorter than the predetermined value.

If larger quantity of the fuel is supplied for combustion in the engine within a predetermined time elapsing from start to stop of the engine, the temperature within the cylinder increases at an earlier stage. This makes it possible to restrain adhesion of the fuel to the inner peripheral surface of the cylinder at the earlier stage, and to further promote evaporation of the fuel at the increasing temperature of the lubricating oil. The rate of increase in the cylinder temperature or the lubricating oil temperature as aforementioned has a correlation with the total amount of combustion heat generated within the cylinder after start-up of the engine. Therefore it is preferable to monitor the total amount of combustion heat generated within the cylinder for the time from start to stop of the engine so as to accurately determine whether the internal combustion engine has been operated at the increasing degree of dilution.

In the aforementioned embodiment, the controller estimates a total quantity of combustion heat generated in a cylinder from start to stop of the internal combustion engine on the basis thereof, and determines that the internal combustion engine is operated in the state where the degree of dilution is increasing when a temperature of the engine at the start is equal to or lower than a predetermined temperature, and the estimated total quantity of the combustion heat is equal to or smaller than a predetermined quantity.

The aforementioned embodiment further makes it possible to determine that the internal combustion engine has been operated under the condition where the degree of dilution is increasing. Accordingly, the increase in the degree of dilution can be accurately estimated. It is preferable to directly detect a temperature within the cylinder as the engine temperature, for example. However, the temperature of the cooling water, intake air temperature, outside temperature or any combination thereof may be used to estimate the engine temperature.

In the aforementioned embodiment, it is accurately determined that the internal combustion engine has been operated under the condition where the degree of dilution is increasing if the engine temperature at start-up is equal to or lower than the predetermined temperature, and the total amount of combustion heat is equal to or less than the predetermined value. The predetermined value with which the total amount of combustion heat is compared may be set to be variable in accordance with the engine temperature at start-up. When the engine temperature at start-up is equal to or lower than the predetermined temperature but measures relatively higher, the increase in the degree of dilution at the earlier operation stage of the engine is reduced. Therefore the total amount of combustion heat required to offset or exceed the increase in the degree of dilution may be reduced. It is preferable to set the predetermined value with which the total amount of combustion heat is compared to be a smaller value as the engine temperature at start-up becomes higher. The aforementioned structure is effective for making the determination whether the internal combustion engine has been operated under the condition where the degree of dilution is increasing.

According to the embodiment, the controller determines that the total quantity of the combustion heat is equal to or smaller than the predetermined quantity when one of a sum of intake air quantity and a sum of fuel injection quantity obtained from the start to stop of the internal combustion engine is equal to or smaller than a predetermined value. The amount of combustion heat within the cylinder resulting from the fuel injection varies with the air/fuel ratio or the injection timing at the fuel injection as well as the intake air quantity, fuel injection quantity and the like. Therefore it is effective to calculate the total amount of combustion heat using the intake air quantity or the fuel injection quantity having a weighting on the basis of the air/fuel ratio or the ignition timing such that the amount of combustion heat is accurately estimated.

According to the aforementioned embodiment, the controller determines whether the degree of dilution is increasing on the basis of one of a lubricating oil temperature and a parameter correlating therewith, and estimates the degree of dilution on the basis of a counter value which is increased when it is determined that the internal combustion engine is operated in the state where the degree of dilution is increasing, and gradually decreased when it is determined that the internal combustion engine is operated in the state where the degree of dilution is decreasing.

As described above, the degree of dilution gradually increases as the cold short-trip, that is, engine operation at the increasing degree of dilution is repeatedly performed. Meanwhile, when the internal combustion engine has been operated for an extended period of time and the lubricating oil temperature increases, quantity of the evaporative fuel contained in the lubricating oil increases. Accordingly the degree of dilution gradually decreases as the elapse of time.

In the aforementioned embodiment, the counter value is set to be variable in accordance with the increase or decrease in the degree of dilution. This makes it possible to estimate the degree of dilution further accurately on the basis of the counter value.

According to the embodiment of the invention, the controller calculates a rate of increase in the degree of dilution on the basis of a parameter correlating with quantity of the fuel adhered to an inner peripheral surface of a cylinder of the internal combustion engine during fuel injection; and estimates the degree of dilution so as to be updated on the basis of the calculated rate of increase.

The degree of dilution gradually increases as the lubricating oil applied on the inner peripheral surface of the cylinder is diluted with the fuel adhered thereto through fuel injection, and the diluted lubricating oil is mixed with the remaining lubricating oil. It is possible to calculate the rate of increase in the degree of dilution, that is, how far the dilution proceeds, on the basis of the quantity of the fuel adhered to the inner peripheral surface of the cylinder during fuel injection (more specifically, the parameter relating thereto).

Accordingly, the current value of the degree of dilution may be updated on the basis of the resultant rate of increase as described above so as to be set to a newly learned value. This makes it possible to accurately estimate the degree of dilution.

It is difficult to directly detect the quantity of the fuel adhered to the inner peripheral surface of the cylinder. In this embodiment, the controller calculates the rate of increase in the degree of dilution using a parameter correlating with the quantity of the fuel adhered to the inner peripheral surface of the cylinder, which includes at least one of fuel injection quantity, fuel injection timing, and a temperature of the internal combustion engine. The quantity of the fuel adhered to the inner peripheral surface tends to increase in the following conditions where:

(a) the fuel injection quantity is large;
(b) the fuel injection timing is set at a timing when the piston is located closer to the bottom dead center side; and
(c) the engine temperature is relatively low.

The quantity of fuel adhered to the inner peripheral surface may be obtained considering the above-described conditions.

According to the embodiment, the controller further estimates quantity of the fuel evaporating from the lubricating oil on the basis of one of a lubricating oil temperature and a parameter correlating therewith, calculates a rate of decrease in the degree of dilution on the basis of the estimated quantity of the fuel, and learns the degree of dilution so as to be updated on the basis of the calculated rates of increase and decrease.

The dilution of the lubricating oil gradually becomes extinct as the lubricating oil temperature rises up in the engine combustion heat and the like, and the fuel contained in the lubricating oil evaporates as the lubricating oil temperature rises. It is, thus, possible to calculate the rate of decrease in the degree of dilution, that is, how far the dilution gets extinct on the basis of the lubricating oil temperature or the parameter correlating therewith.

In the aforementioned embodiment, the current value of the degree of dilution is updated on the basis of not only the rate of increase in the degree of dilution but also the rate of decrease in the degree of dilution so as to be set to a newly learned value. As a result, the degree of dilution can further be accurately estimated on the basis of the rates of both increase and decrease in the degree of dilution.

According to an embodiment, an evaporative fuel processing system for an in-cylinder injection type internal combustion engine includes an evaporative fuel processing mechanism that includes a canister to which an evaporative fuel in a fuel supply system is adsorbed and performs an operation of purging of the adsorbed evaporative fuel into an intake system of the internal combustion engine. The system further includes a controller that obtains a plurality of air/fuel ratio learned values corresponding to a plurality of engine load regions, each of which is used for compensating a variance tendency of an actual air/fuel ratio with respect to a target air/fuel ratio on a steady basis, and inhibits the purging operation performed by the evaporative fuel processing mechanism when a value representative of a variance of a first air/fuel ratio learned value corresponding to a highest engine load region among the plurality of engine load with respect to a second air/fuel ratio learned value corresponding to a lowest engine load region is equal to or larger than a predetermined value.

The rate of change in the quantity of the evaporative fuel in the lubricating oil is considerably lower than the rate of change in the fuel injection quantity resulting from the change in the engine operating state. The steady variance tendency of the actual air/fuel ratio with respect to the target air/fuel ratio according to the evaporative fuel quantity is reflected on the correction amount, i.e., air/fuel ratio learned value, for compensating the steady variance tendency of the actual air/fuel ratio with respect to the target air/fuel ratio.

During engine operation at low load, the quantity of the fuel injected from the fuel injection valve becomes relatively small. In this case, if the fuel evaporates from the lubricating oil, the ratio of the fuel evaporative quantity to the fuel quantity supplied to the internal combustion engine becomes higher compared with the engine operation at high load. That is, the air/fuel ratio variance tendency obtained during the engine operation at low load is different from the variance tendency obtained during the engine operation at high load.

In the aforementioned embodiment, performance of purging is inhibited if the variance of the air/fuel ratio learned value between the low load engine operation and the high load engine operation is determined to be larger than the predetermined value. This makes it possible to accurately determine that the quantity of the evaporative fuel from the lubricating oil is increasing. On the basis of the determination, performance of purging is inhibited.

The variance tendency may be derived from the deviation between the air/fuel ratio learned value KGH obtained during engine operation at high load and the air/fuel ratio learned value KGL obtained during engine operation at low load, that is, KGH-KGL or the ratio of the KGH to the KGL, that is, KGH/KGL. In the case where no fuel evaporates from the lubricating oil, it is effective to correct the aforementioned deviation or ratio to eliminate the variance tendency inherent to the engine existing between the KGH and KHL.

In the aforementioned embodiment, the controller inhibits the purging operation when the value representative of the variance tendency is equal to or larger than the predetermined value, and an air/fuel ratio correction amount of an air/fuel ratio feedback control obtained in accordance with a variance tendency of an actual air/fuel ratio with respect to a target air/fuel ratio increases by a predetermined amount or more so as to compensate the actual air/fuel ratio to a fuel rich side with respect to the target air/fuel ratio.

According to the embodiment, performance of purging is inhibited if the evaporative fuel quantity increases owing to the dilution of the lubricating oil and the variance of the actual air/fuel ratio with respect to the target values is caused by the increased evaporative fuel quantity. This makes it possible to avoid unnecessary inhibition of purging.

The error in learning of the purge concentration becomes noticeable particularly when the fuel injection quantity from the fuel injection valve becomes relatively small. Therefore, in the embodiment, the controller inhibits the purging operation when the engine is operated in a low load state.

According to the embodiment, performance of purging is inhibited during the engine operation at low load. Accordingly, the error in learning of the purge concentration may be prevented in the engine operation at low load while avoiding unnecessary inhibition of purging in the engine operation at high load.

DETAILED DESCRIPTION OF PREFERRED EMBODIMENTS

First Embodiment

Figure 1:
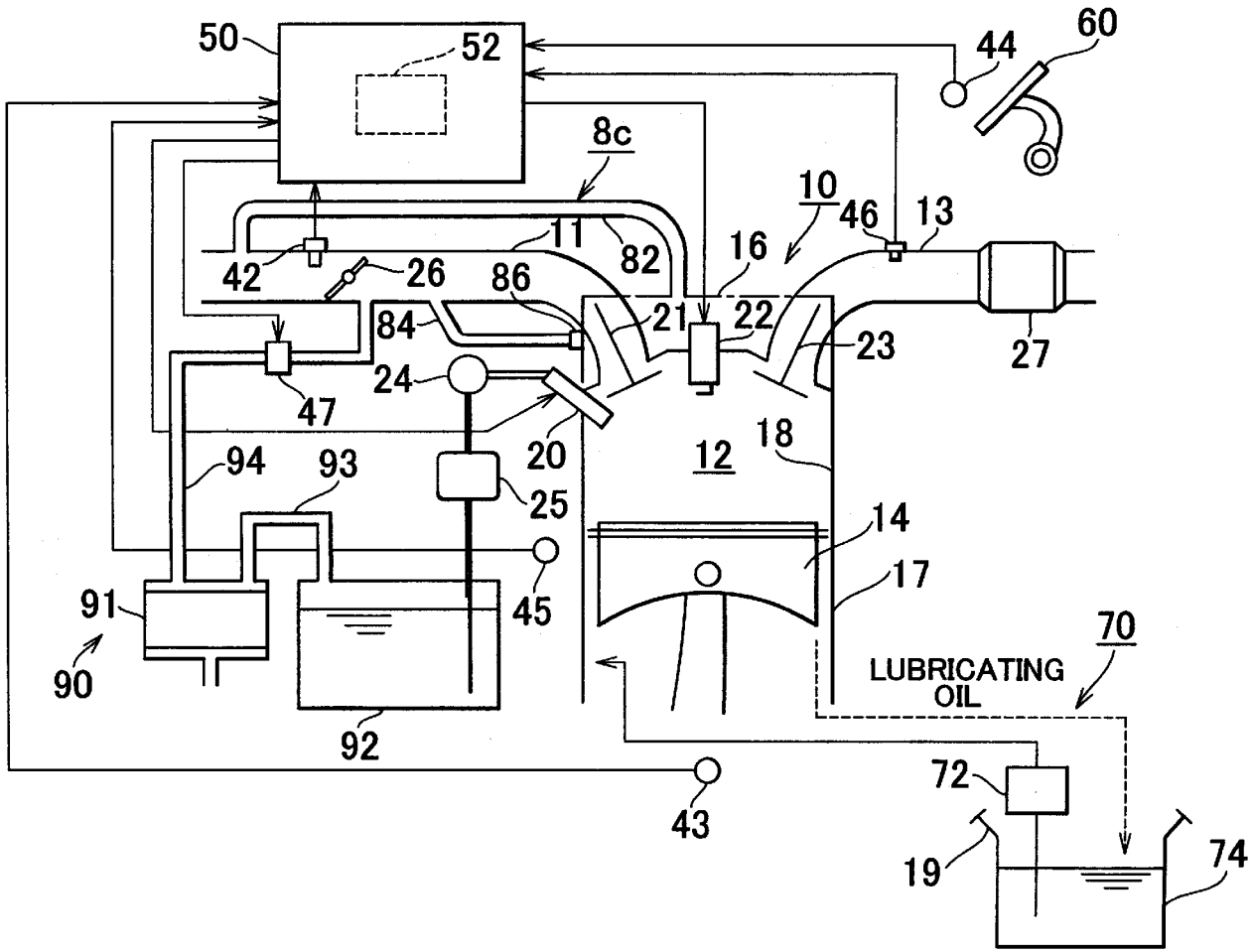
FIG. 1 is a schematic view of an internal combustion engine including an evaporative fuel processing system.

A first embodiment of the invention will be described referring to FIG. 1. FIG. 1 is a schematic view representing an evaporative fuel processing device 90 according to the invention, an internal combustion engine 10 in which the evaporative fuel processing device 90 is provided, and a lubricating system 70 that supplies the internal combustion engine 10 with lubricating oil.

Referring to FIG. 1, the internal combustion engine 10 is of an in-cylinder injection type that directly performs fuel injection into a combustion chamber 12 of each cylinder 17 from a fuel injection valve 20. A piston of an engine (hereinafter referred to as a piston) 14 is reciprocably provided in the cylinder 17. The combustion chamber 12 is defined by a top surface of the piston 14 and an inner peripheral surface 18 of the cylinder 17.

An intake passage 11 and an exhaust passage 13 are respectively connected to the combustion chamber 12. A throttle valve 26 is provided in the middle of the intake passage 11 such that quantity of an intake air introduced into the combustion chamber 12 is adjusted. The intake air introduced into the combustion chamber 12 through an intake valve 21 that is opened is mixed with fuel injected from the fuel injection valve 20 into an air/fuel mixture. The air/fuel mixture is ignited by an ignition plug 22 for combustion, and then is discharged into the exhaust passage 13 from the combustion chamber 12 through an exhaust valve 23 that is opened. A catalytic device 27 having an exhaust emission purifying function is provided in the exhaust passage 13.

The fuel injection valve 20 is connected to a delivery pipe 24 by which the fuel under a predetermined pressure is supplied. The fuel under a predetermined pressure is supplied from a fuel tank 92 to the delivery pipe 24 via a fuel pump 25. The pressure of the fuel in the delivery pipe 24, that is, the fuel injection pressure of the fuel injection valve 20 is adjustable by appropriately changing quantity of the fuel supplied from the fuel pump 25.

The lubricating system 70 of the internal combustion engine 10 includes an oil pan 72 that is formed as a portion of a crank case 19 and a lubricating oil supplier 72. The lubricating oil supplier 72 includes an oil pump, a filter, an oil jet mechanism and the like, which are not shown in the drawing. The lubricating oil in the oil pan 74 is drawn by the oil pump through the filter so as to be fed to an oil jet mechanism. The lubricating oil fed to the oil jet mechanism is supplied to the inner peripheral surface 18 of the cylinder 17 such that the gap between the piston 14 and the inner peripheral surface 18 is lubricated. The lubricating oil is then rubbed down from the inner peripheral surface 18 as the piston 14 reciprocates so as to be returned to the oil pan 74.

The returned lubricating oil is then mixed with the lubricating oil stored in the oil pan 74 so as to be used for lubricating the internal combustion engine 10 again. The lubricating oil that is supplied to the inner peripheral surface 18 for lubricating the piston 14 is warmed in the heat of engine combustion and then is returned to the oil pan 74. When circulation of the lubricating oil by the lubricating system 70 is started upon start-up of the engine, the average temperature of the lubricating oil gradually increases until the lubricating oil is brought into a thermally equilibrium state.

The internal combustion engine is further provided with a crankcase emission control system 80 that treats blowby gas in the crank case 19 by scavenging. The crankcase emission control system 80 includes a communicating passage 82 that connects a portion upstream of the throttle valve 26 within the intake passage 11 with an inside of a head cover 16, and a blowby gas passage 84 that connects a portion downstream of the throttle valve 26 within the intake passage 11 with the inside of the head cover 16.

When the intake pressure in the intake passage 11 becomes negative as the internal combustion engine 10 is operated, new air is introduced into the head cover 16 through the communicating passage 82. The introduced new air is mixed with the blowby gas so as to be circulated in the internal combustion engine 10, and finally discharged into the intake passage 11 through the blowby gas passage 84. The blowby gas is treated by the scavenging operation of the crankcase emission control system 80 without being discharged to the outside. A flow control valve 86 is provided in the middle of the blowby gas passage 84 so as to adjust a flow rate of the blowby gas flowing therein.

The evaporative fuel processing system 90 includes a canister 91, a passage 93 that communicates the canister 91 with the fuel tank 92, a purge passage 94 that communicates the canister 91 with a portion downstream of the throttle valve 26 and the like. A flow control valve 47 is provided in the middle of the purge passage 94 such that quantity of an evaporative fuel (flow rate of purge) introduced into the intake passage 11 from the canister 91 is controlled.

The combustion pattern of the internal combustion engine 10 is controlled in accordance with a load state of the operating engine. If, for example, the engine is operated at a high load, the combustion pattern is set to a uniform charge combustion. The uniform charge combustion pattern is achieved by controlling the fuel injection quantity such that an air/fuel (A/F) ratio becomes in the vicinity of a theoretical A/F ratio, for example, between 12 and 15, and by setting the fuel injection timing at the intake stroke (hereinafter referred to as an intake stroke injection).

Meanwhile, if the engine is operated at a low load, the combustion pattern is set to a stratified charge combustion. The stratified charge combustion pattern is achieved by controlling the fuel injection quantity such that the A/F ratio becomes leaner than the theoretical A/F ratio, for example, between 17 and 40, and by setting the fuel injection timing at the compression stroke (hereinafter referred to as a compression stroke injection).

If the engine is operated in an intermediate load, the combustion pattern is set to a pattern close to the stratified charge combustion so as to be smoothly changed between the stratified charge combustion and the uniform charge combustion while restraining the fluctuation in the engine output. In the aforementioned combustion pattern, combustion is performed in the state where the level of the stratification is not high as that of the stratified charge combustion. This combustion pattern is achieved by controlling the fuel injection quantity such that the A/F ratio becomes leaner than the theoretical A/F ratio, for example, between 15 and 25, and by setting the fuel injection timing both at the intake stroke and at the compression stroke (hereinafter referred to as a two-stage injection).

In cold state of the engine where a temperature of an engine cooling water THW is equal to or lower than a predetermined temperature THWL, it is difficult to promote atomization of the injected fuel. In the cold state of the engine, therefore, the combustion pattern is set to the uniform charge combustion regardless of the load state of the engine operation, and the intake stroke combustion is performed. As a result, the length of time from the fuel injection to ignition can be sufficiently long compared with the stratified charge combustion performed by the compression stroke injection. This makes it possible to promote atomization of the injected fuel.

Even when the engine has been already warmed up, for example, the temperature of the engine cooling water THW is equal to or higher than the predetermined temperature THWL, and the engine is operated at the low load, the combustion pattern is set to the stratified charge combustion regardless of the load state of the engine operation so far as predetermined conditions are satisfied, for example, learning of the A/F ratio has not been completed during the engine operation.

The aforementioned combustion pattern control or purge control are executed by an electronic control unit (hereinafter referred to as an ECU) 50. The ECU 50 includes an arithmetic unit, a driving circuit, and a memory 52 that stores arithmetic results of various control operations and a function map used for the arithmetic operations.

Various kinds of sensors are provided in the internal combustion engine 10 so as to detect the operation state thereof. An intake air sensor 42 for detecting intake air quantity is provided upstream of the throttle valve 26 in the intake passage 11. An engine speed sensor 43 for detecting an engine speed (rotational speed of the engine) is provided in the vicinity of an output shaft (not shown) of the internal combustion engine 10. An accelerator sensor 44 for detecting a depression amount (accelerator opening) of an accelerator pedal 60 is provided in the vicinity thereof. A water temperature sensor 45 for detecting a temperature of the engine cooling water is provided in a cylinder block (not shown). An $O_2$ sensor 46 for detecting an A/F ratio on the basis of an oxygen concentration of the exhaust gas is provided upstream of the catalytic device 27 in the exhaust passage 13. The respective detection results of those sensors 42 to 46 are transmitted to the ECU 50 that executes various control operations on the basis of those detection results in accordance with the engine operating state.

Described hereinafter are control procedures for calculating the fuel injection quantity at the uniform charge combustion (process for calculating the fuel injection quantity, A/F ratio feedback control, process for learning the A/F ratio), and control procedures for diagnosing abnormality in the fuel injection system of the internal combustion engine 10 such as the fuel injection valve 20, delivery pipe 24, a fuel pump serving to supply fuel thereto and the like (a process for determining abnormality, a process for determining inhibiting conditions).

At the cold state of the engine, a portion of the fuel injected from the fuel injection valve 20 into the combustion chamber 12 adheres to the inner peripheral surface 18 of the cylinder 17. The aforementioned adhesion of the fuel may cause dilution of the whole lubricating oil, increasing quantity of the evaporative fuel. This may adversely affect the purging control.

In this embodiment, a process for monitoring the operation history of the internal combustion engine 10 in the state where dilution degree of the lubricating oil is increasing, i.e., the history of executing cold short-trip, is executed. This makes it possible to monitor that the dilution of the lubricating oil has adversely influenced the purge control. If it is monitored that the purge control has been adversely influenced by the dilution of the lubricating oil, performance of purge control is inhibited so as to avoid the error in learning of the purge concentration as much as possible.

1. Process for Monitoring Engine Operation

Figure 2:
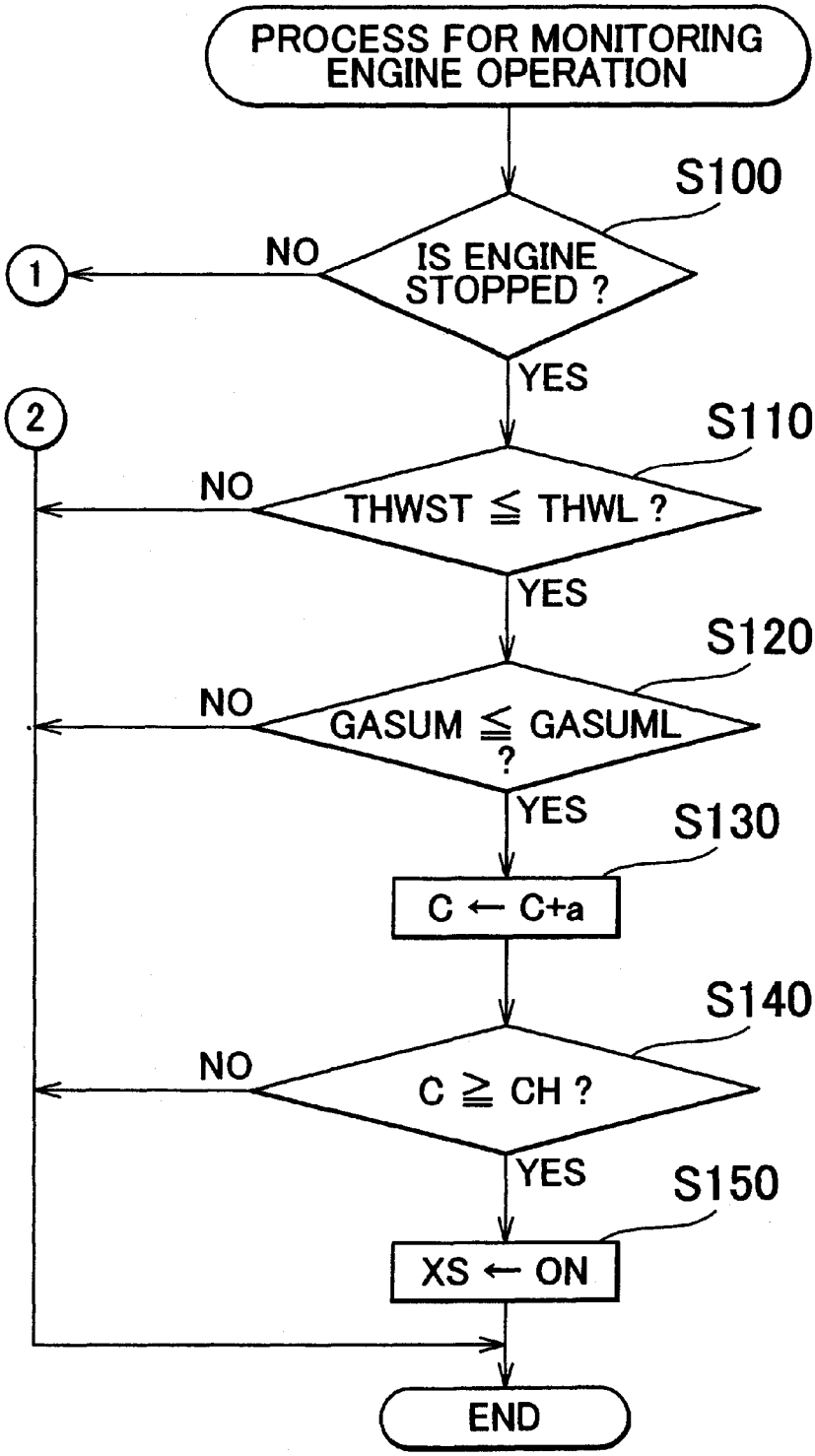
FIG. 2 is a flowchart representing a control routine for monitoring an operation of the internal combustion engine.
Figure 3:
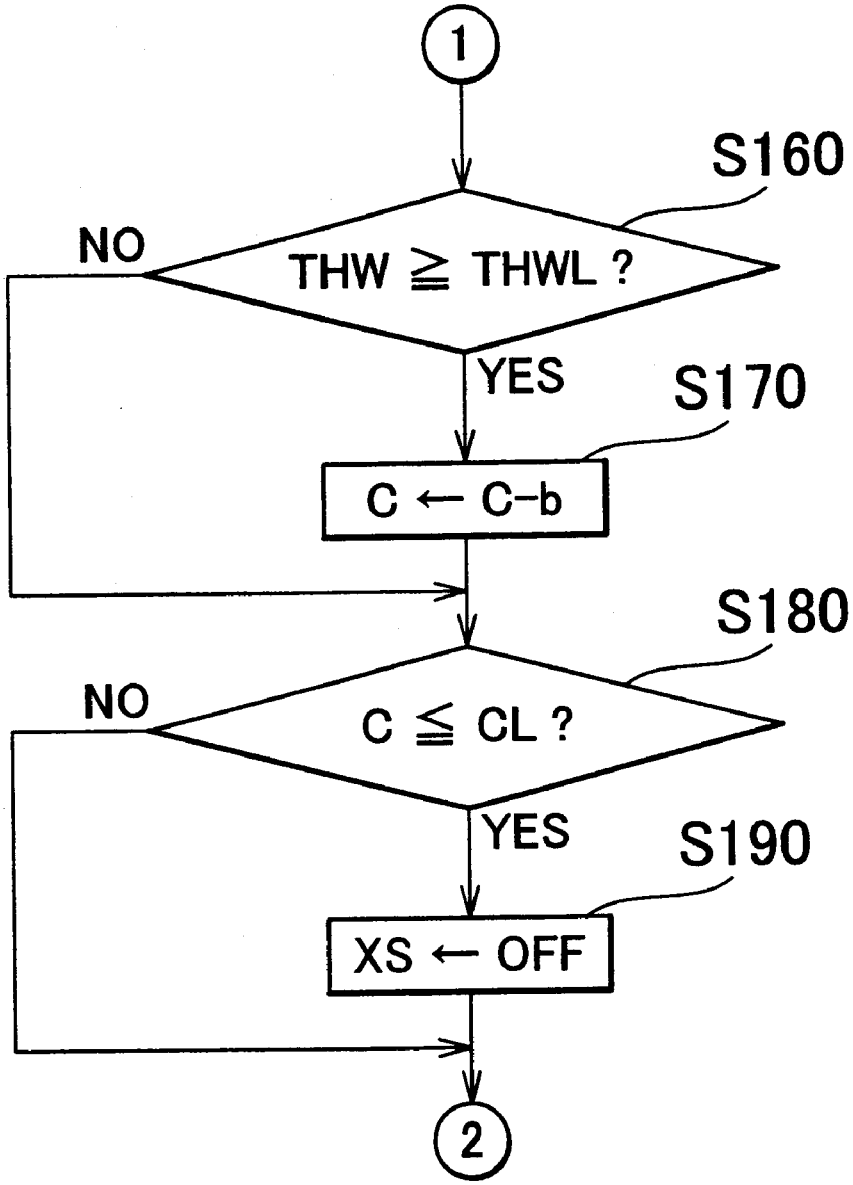
FIG. 3 is a flowchart representing a control routine for monitoring an operation of the internal combustion engine.

The process for monitoring the operation history of the internal combustion engine 10 will be described. Flowcharts shown in FIGS. 2 and 3 represent the procedure for monitoring the operation history of the internal combustion engine 10. The ECU 50 repeatedly executes a series of the aforementioned process at a predetermined interval. A timing chart shown in FIG. 4 represents an exemplary control pattern obtained from executing the process.

Referring to the flowchart in FIG. 2, first in step S100, it is determined whether the operation of the internal combustion engine 10 has been stopped. The ECU 50 is configured to continuously receive power supply until a predetermined time period elapses after stop of the internal combustion engine 10 so as to be kept operable. The ECU 50 executes a post processing required for the subsequent engine operation by storing control results during the engine operation in the memory 52 before the predetermined time period elapses after the stop of the engine.

Figure 4:
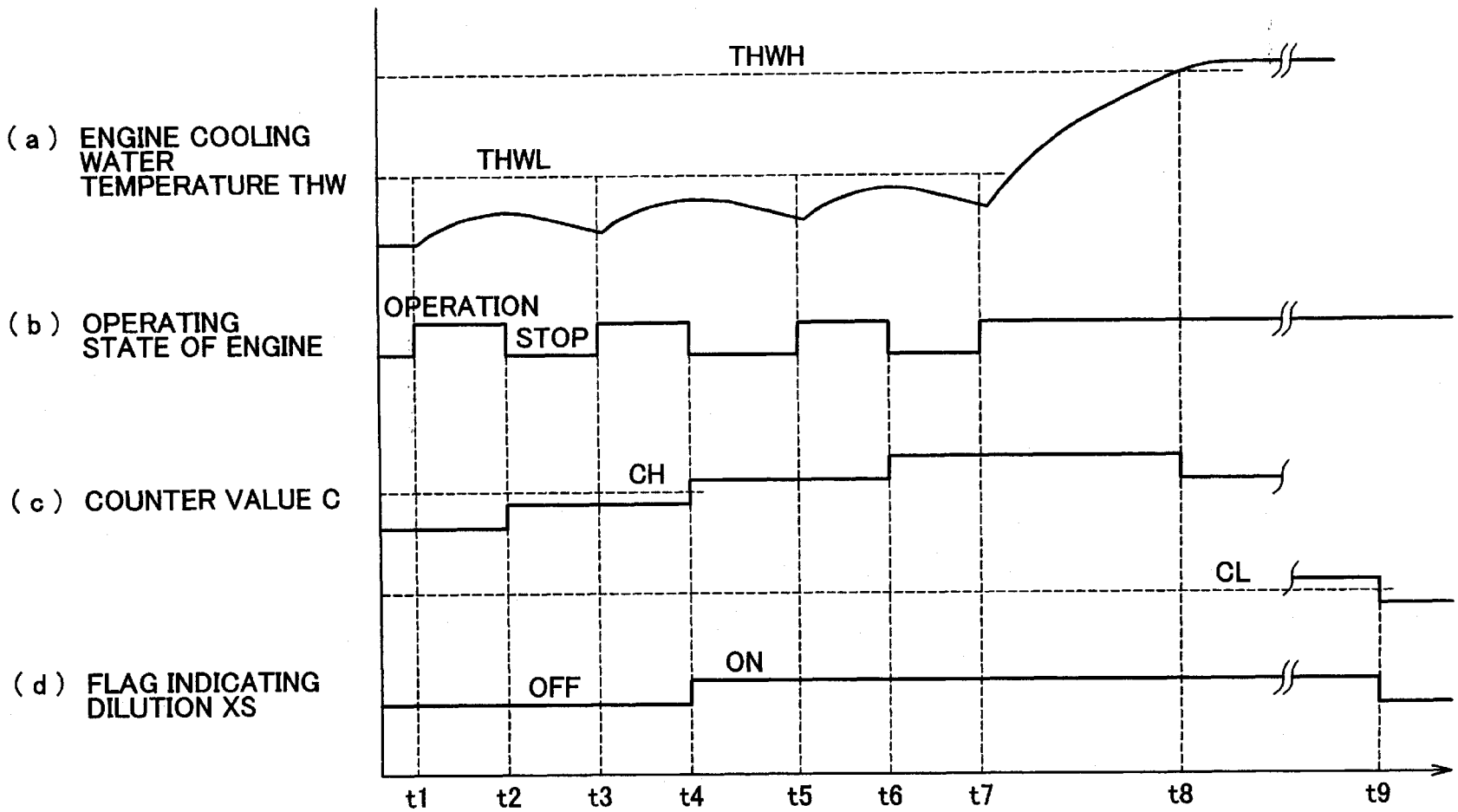
FIG. 4 is a timing chart representing an operation state of a flag that indicates occurrence of dilution with reference to various parameters.

If YES is obtained in step S100, that is, it is determined that the engine operation has been stopped at timings t2, t4, t6 as shown in FIG. 4, for example, the process proceeds to step S110. In step S110, the temperature of the engine cooling water THW at start of the engine, that is, the water temperature at start of the engine (hereinafter referred to as THWST) is read from the memory 52. It is then determined whether the THWST is equal to or lower than a predetermined temperature THWL. More specifically, it is determined whether the engine is started in the condition where combustion has been completed while keeping a portion of the injected fuel adhered on the inner peripheral surface 18, that is, dilution of the lubricating oil is expected to occur as described above.

If YES is obtained in step S110, that is, it is determined that the water temperature THWST is equal to or lower than the predetermined temperature THWL, indicating that the engine has been started in the condition where dilution of the lubricating oil is expected to occur at timings t1, t3, t5, t7 as shown in FIG. 4, the process proceeds to step S120. In step S120, it is further determined whether a sum of the intake air quantity GASUM after start of the engine is equal to or less than a predetermined value GASUML.

If the internal combustion engine 10 is continuously operated for a long period of time even at the low THWST, the temperature of the combustion chamber 12 increases to promote atomization of the injected fuel. Accordingly, adhesion of the fuel to the inner peripheral surface 18, thus, may be restrained. The temperature of the lubricating oil gradually increases in the heat resulting from the engine combustion. The quantity of the fuel evaporated from the lubricating oil, thus, increases along the rise in the lubricating oil temperature.

Even if the water temperature THWST is low and the dilution degree of the lubricating oil temporarily increases at an early stage of the engine operation, it gradually decreases as the fuel evaporates from the lubricating oil at the subsequent operation of the engine. If the decrease in the dilution degree serves to offset or exceed the increase in the dilution degree at the early stage of the engine operation, the operation history of the internal combustion engine 10 that has been operated in the condition where the dilution degree of the lubricating oil is increasing, that is, the history of cold short-trip of the internal combustion engine 10 does not have to be recorded.

The combustion heat generated at each combustion stroke is correlated with the intake air quantity or the fuel injection quantity that is set on the basis of the intake air quantity at each stroke. The combustion heat tends to be increased as the intake air quantity or the fuel injection quantity increase. As a result, the combustion heat generated during the engine operation is considered to have a correlation with the sum of the intake air quantity GASUM.

If the predetermined value GASUML is set to an appropriate value in step S120, it is possible to determine whether the decrease in the dilution degree of the lubricating oil caused by the fuel evaporating from the lubricating oil at increasing temperature during engine operation serves to offset or exceeds the increase in the dilution degree of the lubricating oil that has occurred at the early stage of the engine operation.

In step S120, at a timing when the stratified charge combustion is allowed as rise of the engine cooling water temperature, NO is obtained. That is, in step S120, the predetermined value GASUML is compared with the sum of the intake air quantity GASUM during the intake stroke injection where the combustion pattern is set to the uniform charge combustion at cold state of the engine.

If YES is obtained in step S120, that is, if it is determined that the GASUM is equal to or less than the predetermined value GASUML, indicating that the present engine operation corresponds to the cold short-trip, the process proceeds to step S130. In step S130, a value "a" is added to the dilution counter value C so as to be counted up at timings t2, t4, t6 as shown in FIG. 4. The dilution counter value C indicates the degree to which the dilution of the lubricating oil has proceeded. Therefore the counter value C is controlled to become larger as the dilution degree increases, and to become smaller as it decreases. The count-up process in step S130 is executed if it is determined that the count-up process has not been executed even after the determination of stop of the engine. That is, the count-up process is executed only once after stop of the engine.

If YES is obtained in step S130, that is, the count value C is counted up by the value "a", the process proceeds to step S140 where it is determined whether the counter value C is equal to or larger than a predetermined reference value CH. If YES is obtained in step S140, that is, the counter value C is equal to or larger than the reference value CH, it is determined that the dilution degree of the lubricant oil is increasing. It can be determined that further increase in the dilution degree may adversely influence the A/F ratio feedback control and consequently the purge control. The process then proceeds to step S150 where a fuel dilution flag XS is set to ON at the timing t4 as shown in FIG. 4. In the process for determining conditions for inhibiting purge control (to be described later), setting the dilution flag XS to ON is one of conditions for inhibiting execution of the purge control. When the dilution flag XS is set to ON, the series of process ends.

Meanwhile, if NO is obtained in step S100, that is, if it is determined that the internal combustion engine 10 is operated, the process proceeds to step S160 as shown in a flowchart of FIG. 3. In step S160, it is determined whether the cooling water temperature THW is equal to or higher than the predetermined temperature THWH.

In step S160, comparison between the THW and the THWH is performed so as to determine whether the average temperature of the lubricating oil as a whole has increased to be equal to or higher than a predetermined temperature. This makes it possible to determine whether the quantity of the fuel evaporating from the lubricating oil increases to a predetermined value as the rise in the lubricating oil temperature, and the dilution degree of the lubricating oil tends to decrease. Increase in the cooling water temperature THW indicates that a large amount of combustion heat is generated after start of the engine. This makes it possible to easily determine that the evaporative fuel quantity has increased enough to decrease the dilution degree of the lubricating oil resulting from increase in the lubricating oil temperature owing to the combustion heat.

If YES is obtained in step S160, that is, the THW is equal to or higher than the THWH, or the quantity of the evaporative fuel has increased to be equal to or larger than the predetermined quantity resulting from increase in the lubricating oil temperature as a whole, the process proceeds to step S170. In step S170, a predetermined value "b" is subtracted from the dilution counter value C so as to be counted down at timings t8 and t9 as shown in FIG. 4 The count-down process in step S170 is executed when a predetermined time period has elapsed from execution of the previous count-down process. That is, the count-down process is executed at an interval of an elapse of a predetermined time period after the THW becomes equal to or higher than the THWH.

Meanwhile if NO is obtained in step S160, that is, when it is determined that the cooling water temperature THW is below the predetermined temperature THWH, the count-down process in step S170 is not executed, and the process proceeds to step S180. In step S180, it is determined whether the counter value C is equal to or smaller than a reference value CL (<reference value CH). When YES is obtained in step S180, that is, the counter value C is equal to or smaller than the reference value CL, it is determined that the dilution degree is low and therefore, adverse influence to the purge control may be negligible even if the dilution temporarily occurs to be further proceeded.

The process then proceeds to step S190 where the dilution flag XS is set to OFF at a timing t9 as shown in FIG. 4. After setting the dilution flag XS to OFF, the routine ends.

Meanwhile when NO is obtained in step S180, that is, the counter value C is equal to or larger than the reference value CL, the operation of the dilution flag XS is not performed, and the routine ends.

Referring to the flowchart of FIG. 2, when NO is obtained in step S110, that is, the water temperature THWST exceeds the predetermined temperature THWL, or NO is obtained in step S120, that is, the sum of the intake air quantity GASUM exceeds the predetermined value GASUML, it is determined that the engine operation in the present cycle does not correspond to the cold short-trip. In the aforementioned cases, the counter value C is not counted up, and the routine ends.

If NO is obtained in step S140, that is, the counter value C is below the reference value CH, it is determined that the dilution is not likely to give the adverse influence to the purge control even if the determination is made that the engine operation corresponds to the cold short-trip so as to count up the counter value C. In this case, the routine ends without setting the dilution flag XS to ON.

2. Process for Calculating Fuel Injection Quantity

Figure 5:
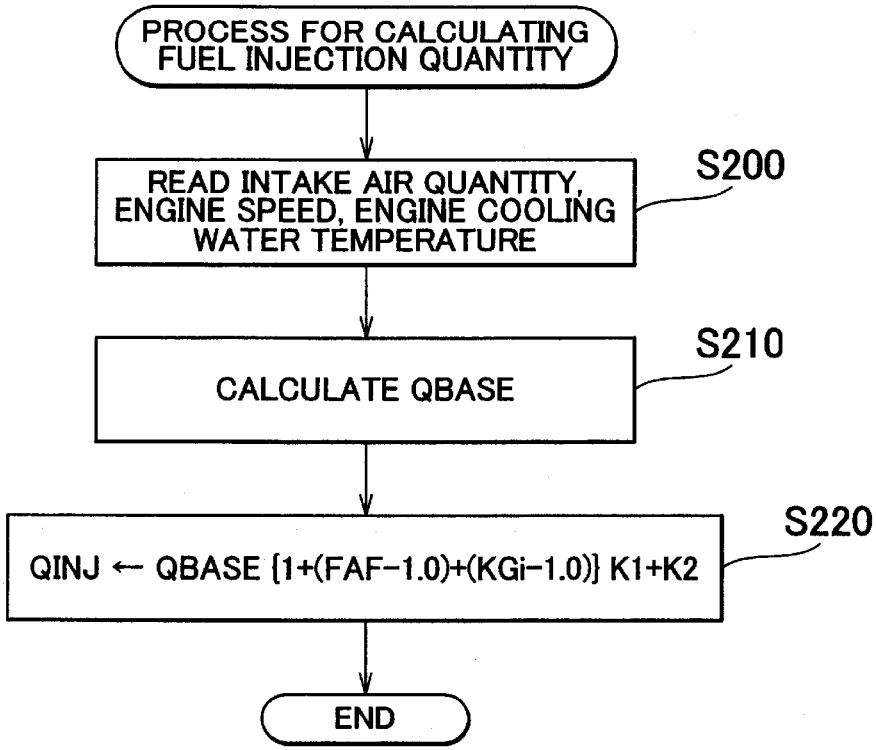
FIG. 5 is a flowchart representing a control routine for calculating the fuel injection quantity.

The process for calculating the fuel injection quantity will be described. A flowchart in FIG. 5 represents the routine for controlling the fuel injection quantity. A series of process shown in the flowchart in FIG. 5 is repeatedly executed by the ECU 50 at a predetermined interval.

First in step S200, parameters indicating the current operating state of the engine such as the accelerator opening, engine speed, engine cooling water temperature THW and the like are read. The process proceeds to step S210 where a basic fuel injection quantity QBASE is calculated on the basis of the respective parameters read in step S200.

The process then proceeds to step S220 where a final fuel injection quantity QINJ is calculated using the following equation (1):

$$QINJ \leftarrow QBASE\{1+(FAF-1.0)+(KGi-1.0)\}K1+K2 \quad (1)$$

where the K1, K2 are correction coefficients; FAF is a feedback correction coefficient for compensating the temporary variance of the actual A/F ratio with respect to the (2)theoretical A/F ratio as the target A/F ratio; and KGi is a learned value of the A/F ratio for compensating the constant variance of the actual A/F ratio with respect to the theoretical A/F ratio. The learned value KGi is obtained to correspond to each of a plurality of regions derived from dividing the engine load area. More specifically, the engine load area is divided into 5 regions Ri (i=1 to 5) in accordance with the intake air quantity.

The region R1 represents the lowest load region, and the region R5 represents the highest load region. The subscript "i" of the learned value KGi relates to the subscript "i" of the region Ri. In other words, if the engine load region corresponds to the region R3, the learned value KG3 of the A/F ratio is selected for calculating the fuel injection quantity using the equation (1).

The learned value KGi is derived from an A/F ratio feedback process and an A/F ratio learning process. In the case where the dilution degree of the lubricating oil becomes high and the tendency of variance of the actual A/F ratio with respect to the theoretical A/F ratio is generated owing to increase in the evaporative fuel quantity from the lubricating oil. In the aforementioned case, the aforementioned variance tendency is reflected on the A/F ratio learned value KGi. After calculating the final fuel injection quantity QINJ in step S220, the routine ends.

3. Process for Executing A/F Ratio Feedback Control

Next, the process for A/F ratio feedback will be described referring to FIGS. 6 and 7. FIG. 7 is a flowchart representing the procedure for calculating the A/F ratio feedback correction coefficient FAF. The ECU 50 repeatedly executes a series of processing shown in the flowchart at a predetermined interval.

First in step S300, it is determined whether the condition for executing the A/F ratio feedback control is established. In this embodiment, the A/F ratio feedback control is executed when it is determined that the following conditions are established, for example:

condition 1: The engine is in the state other than start-up;
condition 2: The fuel cut is not executed;
condition 3: The cooling water temperature THW is equal to or higher than a predetermined temperature; and
condition 4: Activation of the $O_2$ sensor 46 has been completed.

When NO is obtained in step S300, that is, at least one of the aforementioned conditions is not established, it is determined that the condition for executing the A/F ratio feedback control is not established. The process then proceeds to step S340 where the feedback correction coefficient FAF is set to 1.0, and the routine ends. In this case, the feedback control of the fuel injection quantity on the basis of the FAF is not executed.

When YES is obtained in step S300, that is, all the conditions 1 to 4 are established and execution of the A/F ratio feedback control is allowed, the process proceeds to step S302. In step S302, it is determined whether an output voltage Vox of the $O_2$ sensor 46 is below a predetermined reference voltage Vr.

When YES is obtained in step S302, that is, the output voltage Vox is below the reference voltage Vr, it is determined that the A/F ratio is in a fuel-lean side with respect to the theoretical A/F ratio, and the process proceeds to step S310. In step S310, an A/F ratio identification flag XOX is set to 0.

The process further proceeds to step S312 where it is determined whether the value of the flag XOX is equal to the value of the flag XOXO as the value of the flag XOX obtained in the previous cycle of the processing, which will be referred to as the previous flag value XOXO. When YES is obtained in step S312, that is, the flag value XOX is identical to the previous flag value XOXO, it is determined that the A/F ratio is kept in the fuel-lean side with respect to the theoretical A/F ratio, and the process proceeds to step S314. In step S314, a predetermined value "a" (a>0) is added to the feedback correction coefficient FAF so as to be updated.

When NO is obtained in step S312, that is, the value of the flag XOX is not identical to the previous flag value XOXO, it is determined that the A/F ratio has been changed to the fuel-lean value from the fuel-rich value with respect to the theoretical A/F ratio, and the process proceeds to step S316. In step S316, a predetermined skip amount "A" (A>0) is added to the feedback correction coefficient FAF so as to be updated. In this case, the skip amount "A" has a value sufficiently larger than that of the value "a".

If NO is obtained in step S302, that is, the output voltage Vox of the $O_2$ sensor 46 is equal to or higher than the reference voltage Vr, it is determined that the A/F ratio is in the fuel-rich side with respect to the theoretical A/F ratio, and the process proceeds to step S320. In step S320, the value of the flag XOX is set to 1.

The process further proceeds to step S322 where the value of the flag XOX is identical to the previous flag value XOXO. If YES is obtained in step S322, that is, the flag value XOX is identical to the previous flag value XOXO, it is determined that the A/F ratio is kept in the fuel-rich side with respect to the theoretical A/F ratio, and the process proceeds to step S324. In step S324, a predetermined value b (b>0) is subtracted from the feedback correction coefficient FAF so as to be updated If NO is obtained in step S322, that is, the flag value XOX is not identical to the previous flag value XOXO, it is determined that the A/F ratio has been changed to the fuel-rich value from the fuel-lean value with respect to the theoretical A/F ratio, and the process proceeds to step S326. In step S326, a predetermined skip amount B (B>0) is subtracted from the feedback correction coefficient FAF so as to be updated. The skip amount B has a value sufficiently larger than the predetermined value "b".

After executing step S316 or step S326, the process proceeds to step S330 where the A/F ratio learning process is executed to calculate the A/F ratio learned value KGi. The process further proceeds to step S332 where the present flag value XOX is set to the previous flag value XOXO so as to be stored and used for the subsequent processing. The routine then ends.

Figure 6:
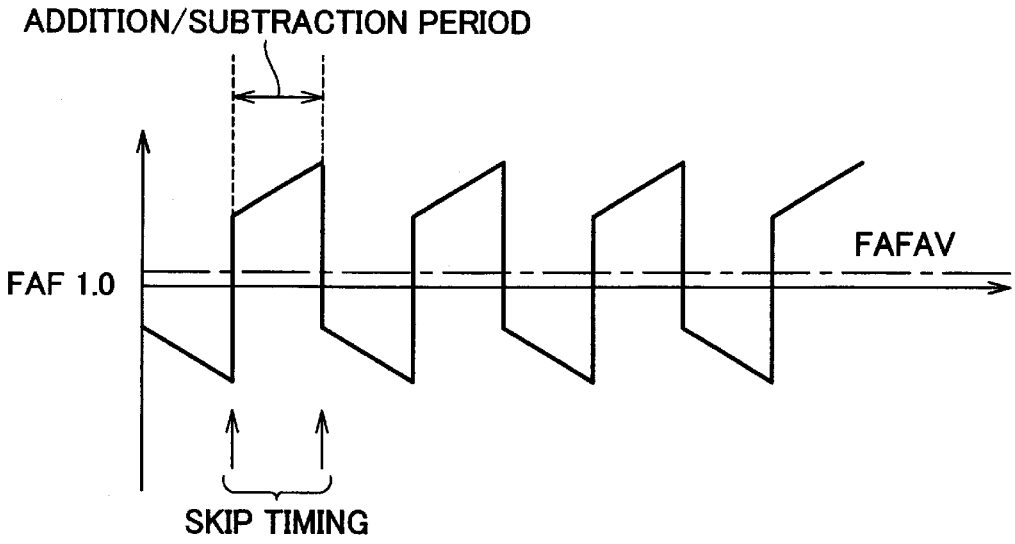
FIG. 6 is a timing chart representing a change in the feedback correction coefficient.
Figure 7:
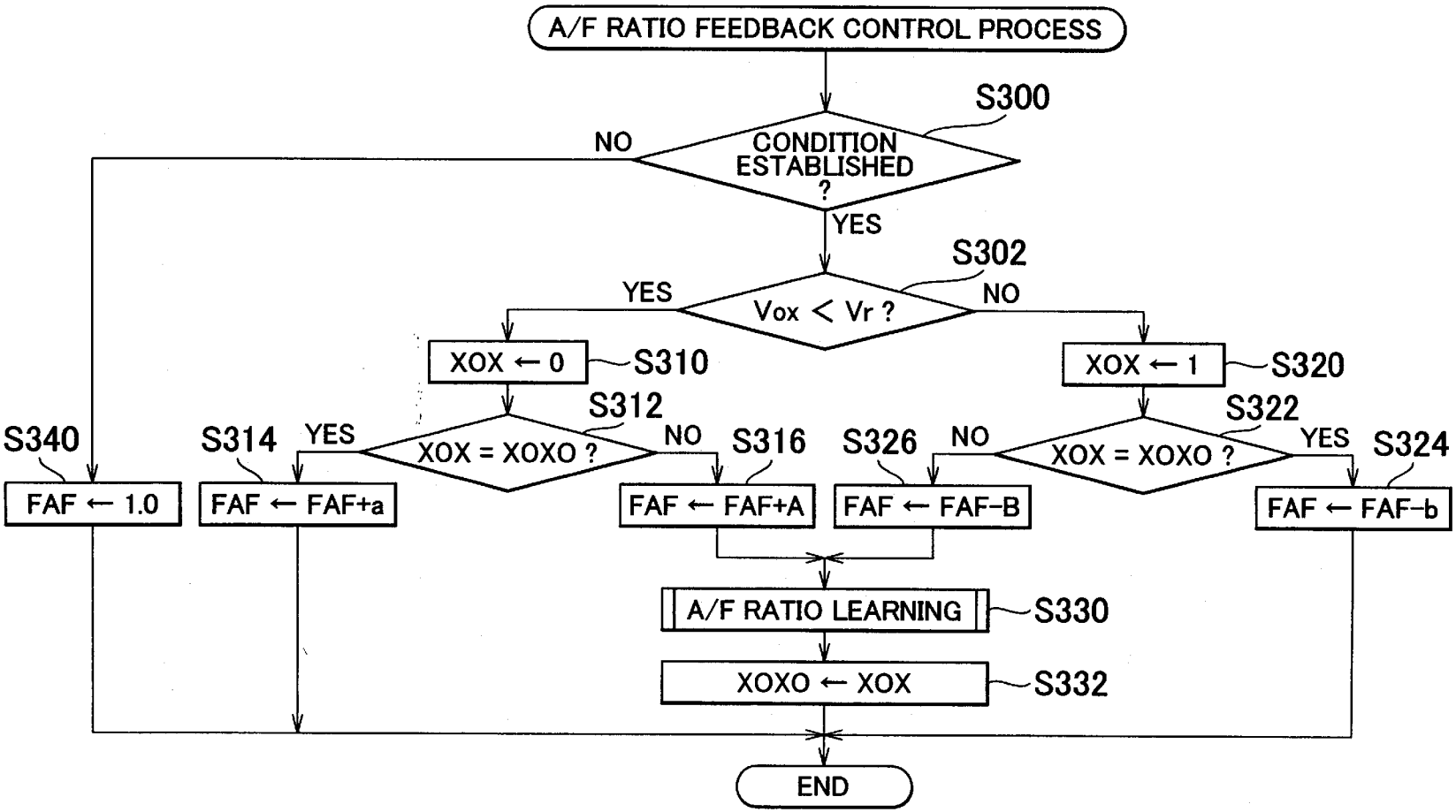
FIG. 7 is a flowchart representing an air/fuel ratio feedback control routine.

FIG. 6 is a chart representing the change in the feedback correction coefficient FAF calculated by the aforementioned A/F ratio feedback control. As shown in FIG. 6, when the output voltage Vox of the $O_2$ sensor 46 changes relative to the reference voltage Vr (skip timing), the feedback correction coefficient FAF is increased by the skip amount A or decreased by the skip amount B so as to be changed by a relatively large amount. In the time period elapsing from the change in the Vox relative to the Vr to the subsequent change in the Vox relative to the Vr (addition/subtraction period), the feedback correction coefficient is increased by the value "a" or decreased by the predetermined value "b" so as to be changed by a relatively small amount.

In the case where there is no variance tendency of the actual A/F ratio with respect to the theoretical A/F ratio on the steady basis, the feedback correction coefficient FAF fluctuates in the range close to its reference value 1.0. Therefore the average value FAFAV of the feedback correction coefficient FAF becomes the same as the value that is substantially equal to 1.0. In the case where there is the variance tendency of the actual A/F ratio to the fuel-lean side or the fuel-rich side with respect to the theoretical A/F ratio on the steady basis owing to the difference in injection characteristics among the respective fuel injection valves 20 and evaporation of the fuel from the lubricating oil, the feedback correction coefficient FAF fluctuates in the range close to the value other than the reference value 1.0. Therefore, the average value FAFAV of the feedback correction coefficient FAF is converged to the value other than the value "1.0" in accordance with the variance tendency. Accordingly it is possible to monitor the variance tendency of the actual A/F ratio with respect to the theoretical A/F ratio on the steady basis based on the variance between the reference value (=1.0) of the feedback correction coefficient FAF and the average value FAFAV. In step S330, the A/F ratio learned value KGi is calculated as a parameter used for monitoring the A/F ratio variance tendency on the steady basis.

4. Process for Learning A/F Ratio

Figure 8:
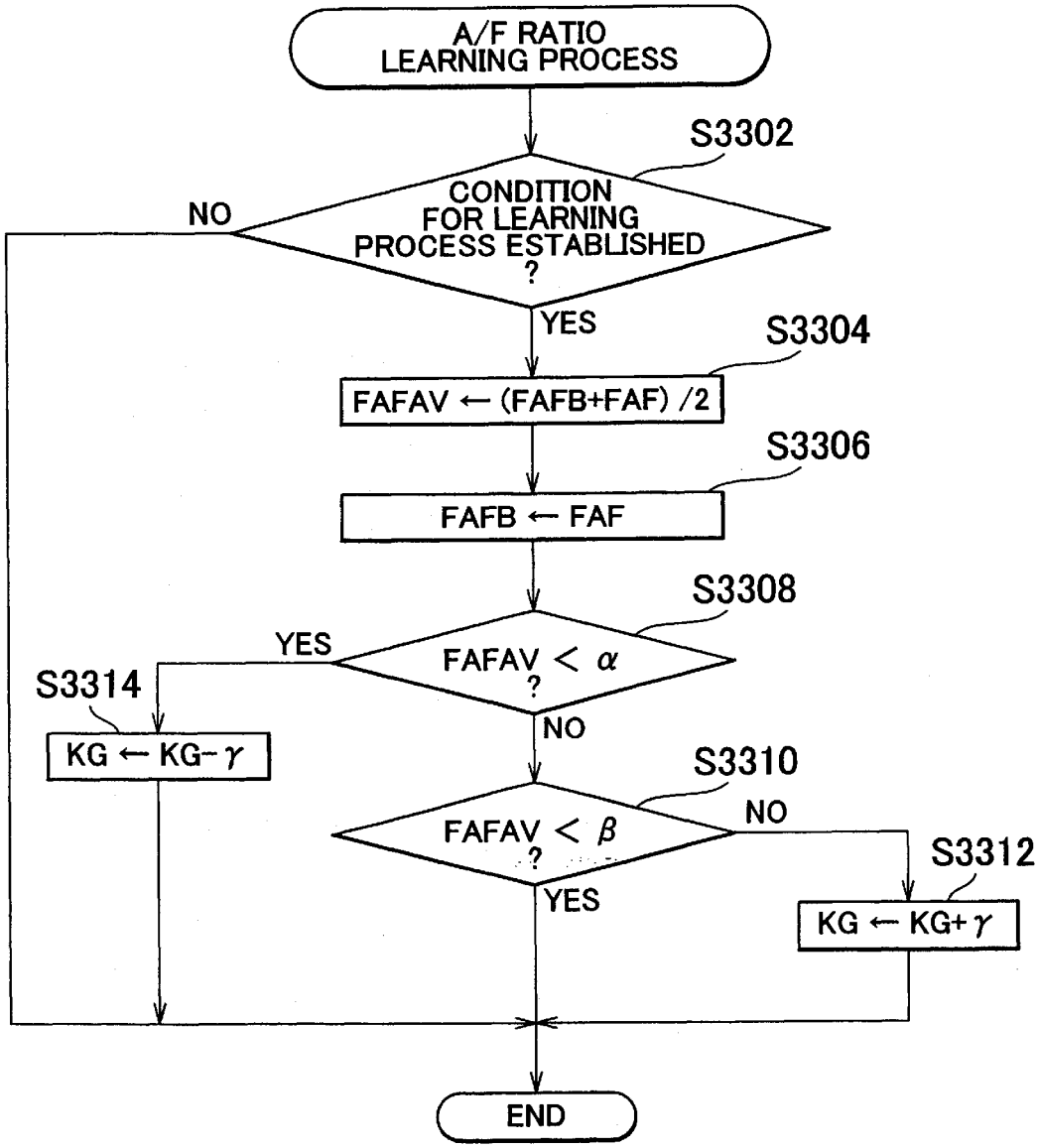
FIG. 8 is a flowchart representing an air/fuel ratio learning control routine.

The process for learning the A/F ratio will be described referring to a flowchart in FIG. 8. The ECU 50 repeatedly executes a series of the process shown in the flowchart at a predetermined interval.

First in step S3302, it is determined whether the condition for executing the A/F ratio learning process is established. In this embodiment, execution of the A/F ratio learning process is allowed when the internal combustion engine 10 has been in a complete warm up state, for example. If NO is obtained in step S3302, that is, it is determined that the condition is not established, the routine ends.

If YES is obtained in step S3302, that is, it is determined that the condition for executing the A/F ratio learning process is established, the process proceeds to step S3304. In step S3304, the average value FAFAV of the feedback correction coefficient FAF is calculated using the following equation (2):

$$FAFAV \leftarrow (FAFB+FAF)/2 \quad (2)$$

where FAFAV represents the value of the feedback correction coefficient FAF obtained by the previous skip processing, that is, through increase by the skip amount A or decrease by the skip amount B.

In this embodiment, an arithmetic average of the FAFB as the feedback correction coefficient FAF obtained when the output voltage Vox of the $O_2$ sensor 46 changes relative to the reference voltage Vr, and the feedback correction coefficient FAF obtained when the output voltage Vox of the $O_2$ sensor 46 subsequently changes relative to the reference voltage Vr is calculated as the average value FAFAV.

After obtaining the average value FAFAV of the feedback correction coefficient FAF in step S3304, the process proceeds to step S3306. In step S3306, the current feedback correction coefficient FAF is set to the FAFB as being the previous value obtained by the previous skip process so as to be stored and used for the subsequent calculating process.

Then in step S3308 and step S3310, it is determined whether the average value FAFAV of the feedback correction coefficient FAF is below predetermined values $\alpha$, $\beta(\beta>1, 0>\alpha)$, respectively. If YES is obtained in step S3308, that is, the average value FAFAV is below the predetermined value $\alpha$, it is determined that the actual A/F ratio has the variance tendency to the fuel-rich side with respect to the theoretical A/F ratio, and the process proceeds to step S3314. In step S3314, the A/F ratio learned value KGi is reduced to compensate the variance tendency. In other words, a predetermined value y is subtracted from the present learned value KGi so as to be updated.

If NO is obtained in step S3310, that is, the average value FAFAV of the feedback correction coefficient FAF is equal to or larger than the predetermined value $\beta$, it is determined that the actual A/F ratio has the variance tendency to the fuel-lean side with respect to the theoretical A/F ratio. The process then proceeds to step S3312 where the predetermined value $\gamma$ is added to the current A/F ratio learned value KGi so as to be updated. After updating the A/F ratio learned value KGi in step S3312 or S3314, the routine ends.

If NO is obtained in S3308, and then YES is obtained in step S3310, that is, the average value FAFAV of the feedback correction coefficient FAF is equal to or larger than the predetermined value $\alpha$, and is below the predetermined value $\beta$, it is determined that the average value FAFAV fluctuates in the range close to the reference value 1.0, and, therefore, there is no variance tendency of the actual A/F ratio with respect to the theoretical A/F ratio. In this case, no update of the A/F ratio learned value KGi is performed, and the routine ends.

5. Process for Learning Purge Concentration

Figure 9:
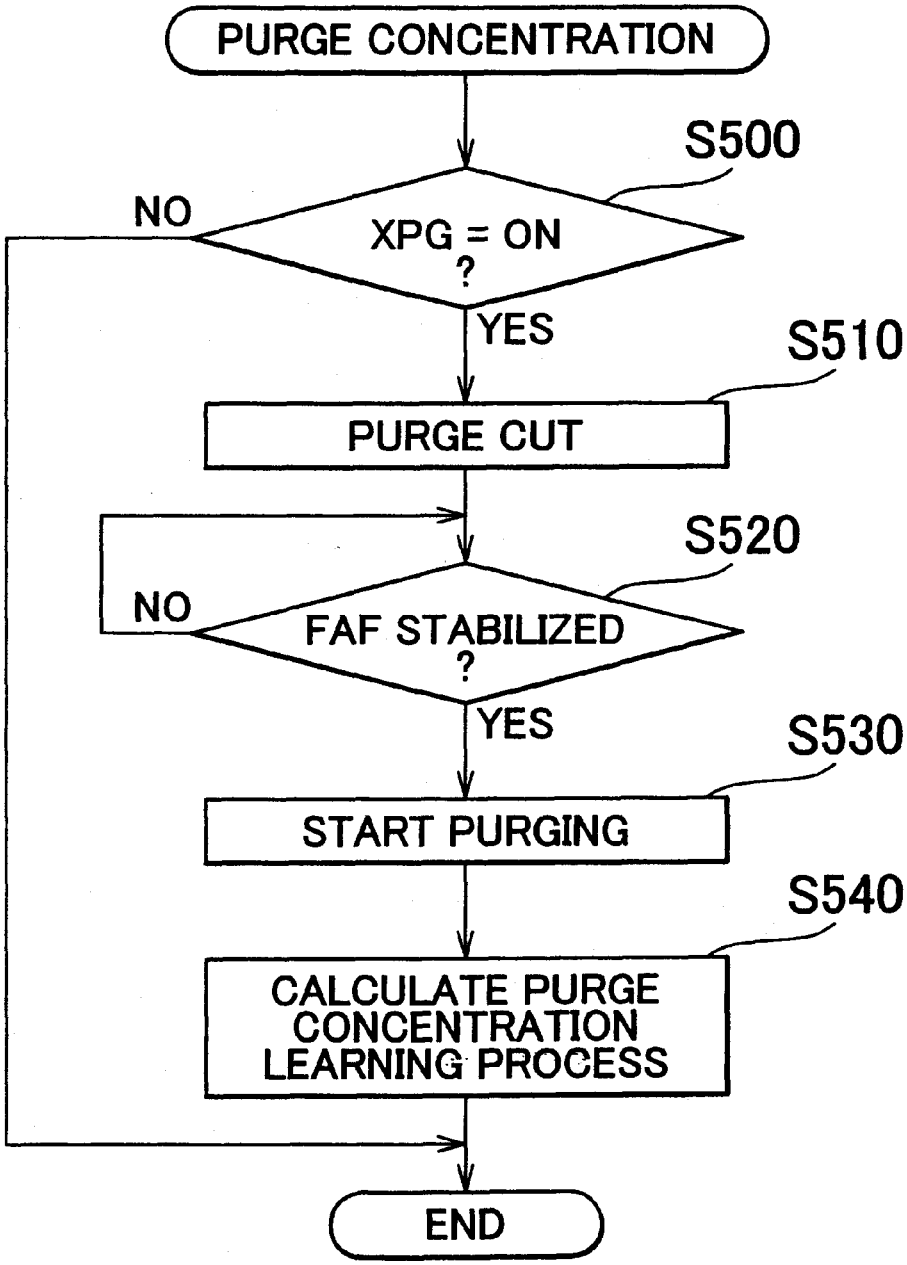
FIG. 9 is a flowchart representing a purge concentration learning control routine.

The process for learning purge concentration will be described referring to the flowchart in FIG. 9. The ECU 50 repeatedly executes a series of process shown in the flowchart in FIG. 9 at a predetermined interval.

First in step S500, it is determined whether a flag XPG indicating permission of purging is set to ON. If NO is obtained in step S500, that is, the flag XPG is set to OFF, execution of purging is inhibited and the routine ends.

Meanwhile, if YES is obtained in step S500, that is, the flag XPG is set to ON, the process proceeds to step S510. In step S510, the flow control valve 47 is closed to temporarily stop purging, and the process proceeds to step S520. In step S520, it is determined whether the feedback correction coefficient FAF is kept in a stable state around the value 1.0. If NO is obtained in step S520, that is, the feedback correction coefficient FAF is not kept in the stable state, the process is repeatedly executed until YES is obtained in step S520.

If YES is obtained in step S520, that is, the feedback correction coefficient FAF is brought into the stable state, the process proceeds to step S530. In step S530, the flow control valve 47 is opened to start purging The process further proceeds to step S540 where change in the feedback correction coefficient FAF after start of purging is monitored, and a purging concentration is calculated on the basis of the monitored change in the FAF, intake air quantity, and the engine speed. The process then proceeds to another routine for executing purging.

6. Process for Determining Condition for Inhibiting Purging

A process for determining a condition for inhibiting execution of purging will be described referring to the flowchart in FIG. 10. The ECU 50 repeatedly executes a series of process in the flowchart at a predetermined interval.

First in step S600, it is determined whether the variance of the actual A/F ratio with respect to the theoretical A/F ratio has been actually caused by the dilution of the lubricating oil. More specifically, it is determined whether the dilution degree is high, and the A/F ratio correction amount FAFKGi has been increased by a predetermined amount so as to compensate the variance tendency to the fuel rich side.

The variance tendency is determined if conditions (1) the flag XS indicating occurrence of dilution is set to ON; and (2) the A/F ratio correction amount FAFAKGi is equal to or smaller than a reference value JMIN1 are both established. The A/F ratio correction amount FAFKGi is calculated using an equation (3) as follows. The subscript "i" of the FAFKGi is related to that of the load region Ri.

$$FAFKGi \leftarrow FAF+KGi-2 \quad (3)$$

The A/F ratio correction amount FAFKGi indicates a correlation between the feedback correction coefficient FAF that varies with a temporary variance tendency of the actual A/F ratio with respect to the theoretical A/F ratio, and the A/F ratio learned value KGi that varies with a steady variance tendency of the actual A/F ratio with respect to the theoretical A/F ratio. In other words, the A/F correction amount FAFKGi is a parameter used for evaluating the A/F ratio variance tendency.

In the case where the actual A/F ratio shows the variance tendency to the fuel-rich side with respect to the theoretical A/F ratio, the A/F correction amount FAFKGi becomes a negative value (FAFKGi<0). Meanwhile, in the case where the actual A/F ratio shows the variance tendency to the fuel-lean side with respect to the theoretical A/F ratio, the A/F correction amount FAFKGi becomes a positive value (FAFKGi>0). Accordingly, if the actual A/F ratio accords with the theoretical A/F ratio, that is, there is no variance tendency of the actual A/F ratio with respect to the theoretical A/F ratio, the A/F correction amount FAFKGi becomes 0 as the reference value.

The aforementioned condition (2), that is, the A/F ratio correction amount FAFAKGi is equal to or smaller than a reference value JMIN1, is considered to determine whether the A/F ratio correction amount FAFKGi has been increased by a predetermined amount (JMIN1) so as to compensate the A/F ratio variance tendency to the fuel-rich side.

Figure 10:
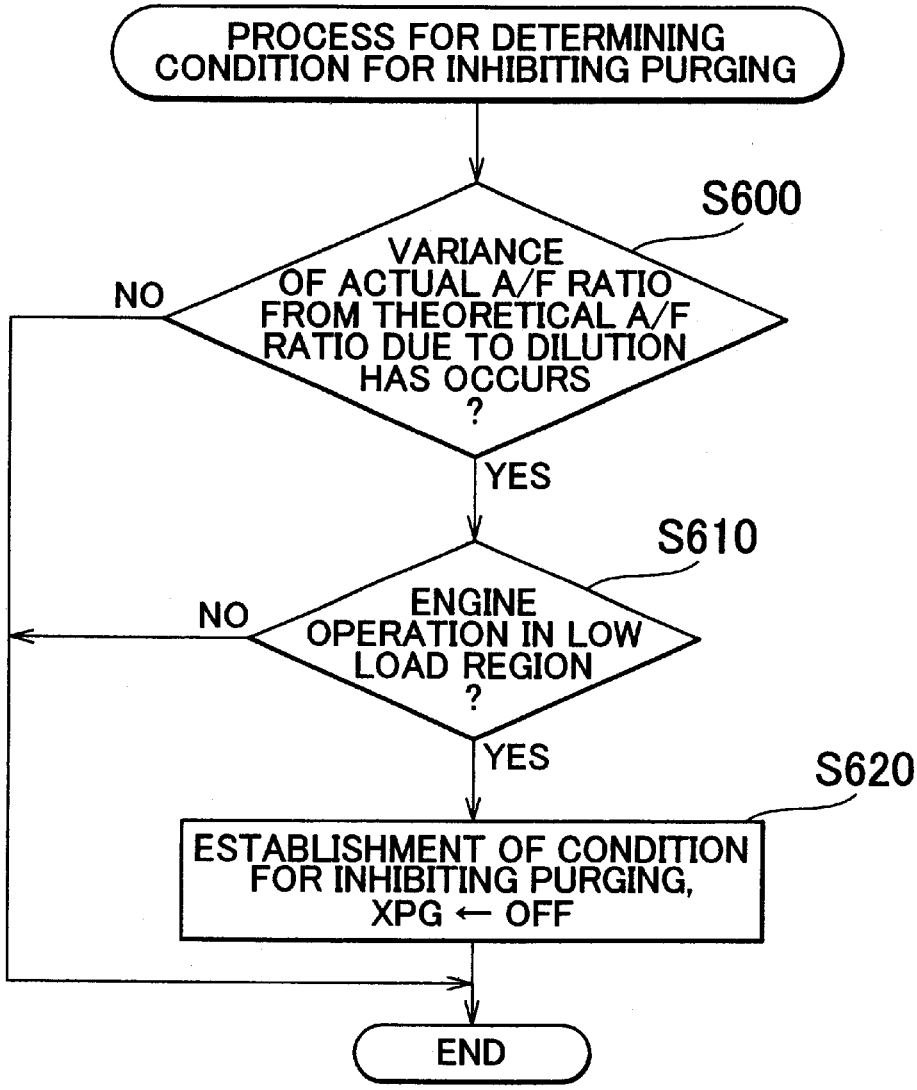
FIG. 10 is a flowchart representing a control routine for determining conditions based on which purging is inhibited.

If YES is obtained in step S600 of the flowchart in FIG. 10, the process proceeds to step S610. In step S610, it is determined whether the internal combustion engine 10 is operated in the low load area. More specifically, it is determined whether the low load area corresponds to the region RI as the lowest load region among those divided in accordance with the intake air quantity.

If YES is obtained in step S610, that is, the internal combustion engine 10 is operated in the low load area, the conditions for inhibiting execution of purging are established, and the flag XPG for permitting execution of purging is set to OFF in step S620. After setting the flag XPG to OFF, the routine ends.

If NO is obtained in step S600 or step S610, the routine ends. The system according to the embodiment where the purging control is executed as described above may provide advantageous effects as described below.

(1) In the embodiment, the dilution degree of the lubricating oil as a whole is estimated, and purging executed by the evaporative fuel processing device 90 is inhibited if the estimated dilution degree is higher than a predetermined level. Even if the evaporative fuel from the lubricating oil is introduced into the intake system, no error occurs in learning of the purge concentration. This makes it possible to restrain fluctuation of the A/F ratio during engine operation at the transient stage of the load owing to the adverse influence of the dilution to the purge control, that is, error in learning of the purge concentration.

(2) The dilution degree of the lubricating oil supplied to lubricate the internal combustion engine 10 is estimated on the basis of the counter value C. The execution of purging is inhibited if the estimated dilution degree is relatively high (flag XS=ON), and thus the quantity of the fuel evaporating from the lubricating oil is increasing. This makes it possible to restrain the error in learning of the purge concentration.

The execution of purging is inhibited on the basis of the condition not only when the dilution degree is high but also when the A/F ratio correction amount FAFKGi is increased by a predetermined or larger amount to compensate the A/F ratio to the fuel-rich side. That is, execution of purging is inhibited if the evaporative fuel quantity is increasing owing to the dilution and the resultant variance has actually occurred in the A/F ratio. In the case where the A/F ratio correction amount FAFKGi is set to the value to compensate the A/F ratio to the fuel-lean side, that is, there is no possibility of error in learning of the purge concentration in spite of high dilution degree, execution of purging is not inhibited. Accordingly unnecessary inhibition of execution of purging, thus, can be avoided.

(3) The operation history of the internal combustion engine 10 under the condition where the dilution degree is increasing, that is, the cold short-trip is monitored. Then the monitored result is referred upon operation of the counter value C. The dilution degree of the lubricating oil, which is generally difficult to be directly detected in the current technology, may be easily estimated.

(4) It is determined that the aforementioned cold short-trip has occurred if the water temperature THWST at engine start-up is equal to or lower than the predetermined temperature THWL, and the sum of the intake air quantity GASUM is equal to or smaller than the GASUML in the stopped state of the engine. This makes it possible to improve reliability of the historical record of the operation of the engine under the condition where the dilution degree is increasing.

(5) Upon the cold short-trip, the counter value C is counted up. Meanwhile, comparison between the cooling water temperature THW and the predetermined temperature THWL is performed to determine whether the dilution degree is decreasing. If it is determined that the dilution degree is decreasing, the counter value C is gradually counted down. This makes it possible to accurately estimate increase or decrease in the dilution degree of the lubricating oil on the basis of the counter value C. This makes it possible to inhibit execution of purging appropriately on the basis of the counter value C. Second Embodiment A second embodiment of the invention will be described. In this embodiment, the procedure for calculating the fuel dilution degree of the lubricating oil is different from that in the first embodiment.

In this embodiment, the increase or decrease in the fuel dilution degree of the lubricating oil is periodically calculated, based on which the currently estimated dilution degree is updated. The updated value is further learned as a new value of the dilution degree.

Figure 11:
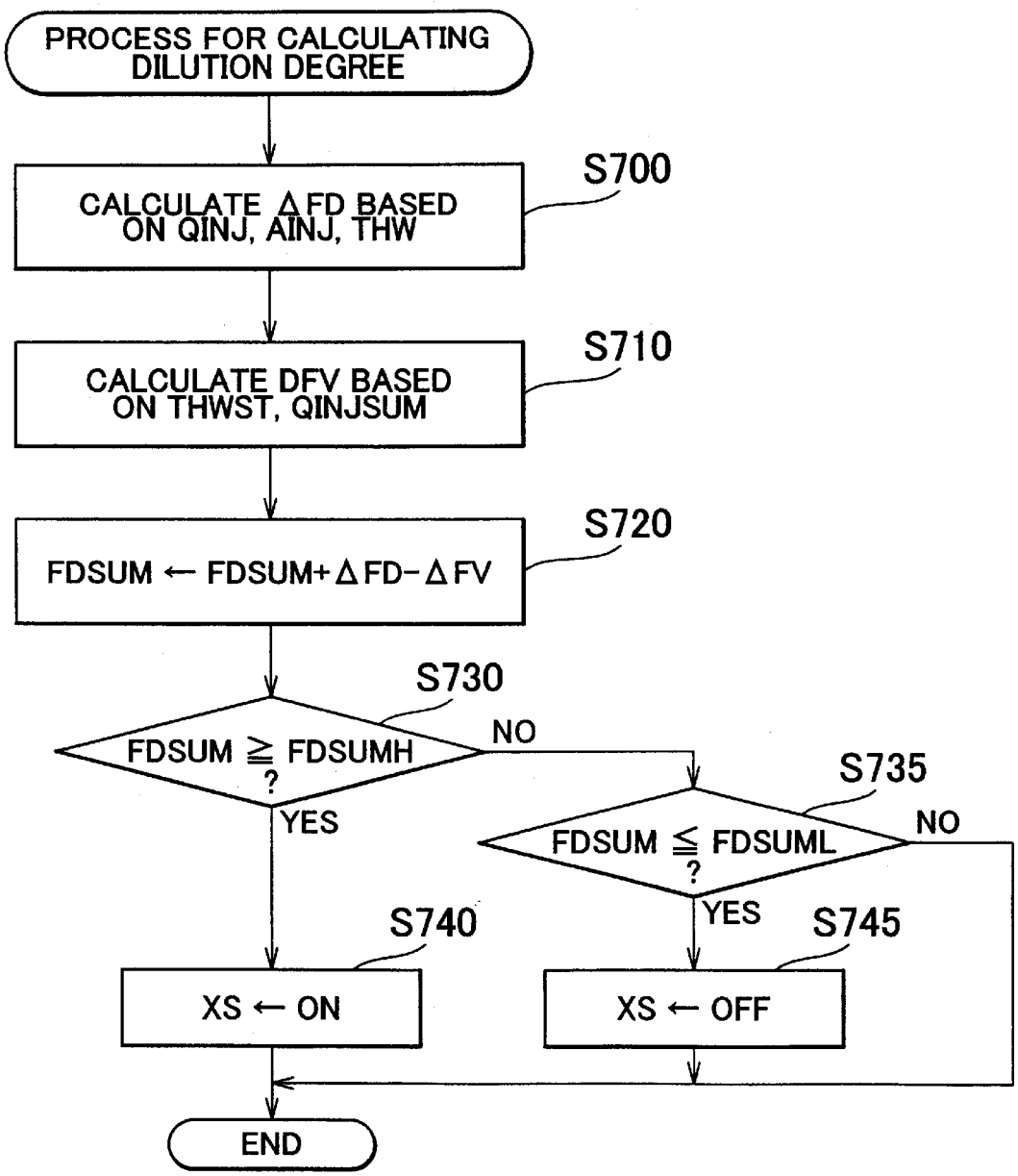
FIG. 11 is a flowchart representing a control routine for calculating dilution degree.

The procedure for calculating the dilution degree of this embodiment will be described by explaining its difference from the first embodiment. A flowchart in FIG. 11 represents the process for calculating the dilution degree. The ECU 50 repeatedly executes a series of process shown in the flowchart in FIG. 11 at a predetermined interval T.

First in step S700, the quantity of the fuel mixed with the lubricating oil per hour ΔFD, that is, the quantity of the fuel mixed with the lubricating oil through fuel injection, is calculated using an equation (4) as described below. The quantity of the fuel ΔFD corresponds to the rate of increase in the dilution degree in the case where evaporation of the fuel from the lubricating oil is not considered.

$$\Delta FD \leftarrow \Sigma f(QINJi,\ AINJi,\ THWi) \tag{4}$$

where i=1, 2, 3, . . . , n; and f( ) represents a function for obtaining the quantity of the fuel mixed with the lubricating oil in one cycle of fuel injection. The fuel injection quantity QINJi, the fuel injection timing AINJ, and the cooling water temperature THW upon the fuel injection are used in the function as parameters. The "i" represents the number of times of execution of the fuel injection from the previous control cycle. If the fuel injection has been executed, for example, three times between the previous and the subsequent control cycles, the equation (4) may be expressed as the following equation (5).

$$\Delta FD \leftarrow f(QINJ1, AINJ2, THW1)+f(QINJ2, AINJ2, THW2)+f(QINJ3, AINJ2, THW3) \quad (5)$$

where f( ) represents a function experimentally obtained in advance, which is stored as a function map in the memory 52 of the ECU 50. The basic features of the function map will be explained below.

The value of the function f( ) is increased as (1) the fuel injection quantity QINJ increases, (2) the fuel injection timing AINJ becomes closer to the retard side, and (3) the cooling water temperature THW becomes lower. The reason for using the fuel injection quantity QINJ, fuel injection timing AINJ, and the cooling water temperature THW as parameters for the function f( ) will be described below.

The dilution of the lubricating oil resulting from fuel injection occurs when the fuel is kept adhered to the inner peripheral surface 18 of the cylinder rather than being subjected to combustion. As the quantity of the fuel adhered to the inner peripheral surface 18 increases, the dilution degree of the lubricating fuel as a whole may be increased accordingly. It is difficult to directly detect the quantity of the fuel adhered to the inner peripheral surface 18 by the current technology. If, however, the parameter related to the quantity of the adhered fuel is appropriately selected, the quantity of the adhered fuel may be accurately estimated.

The fuel injection quantity QINJ, fuel injection timing AINJ, and cooling water temperature THW may be used as exemplary parameters correlating with the quantity of the fuel adhered to the inner peripheral surface 18 of the cylinder.

As the fuel injection quantity QINJ increases, the quantity of the fuel adhered to the inner peripheral surface 18 of the cylinder is increased. The quantity of the fuel adhered to the inner peripheral surface 18 per unit area, that is, thickness of the fuel layer formed on the inner peripheral surface 18 has an upper limit. If the area where the fuel is adhered expands, the thickness of the fuel layer hardly reaches the upper limit, and more quantity of the fuel tends to be adhered to the inner peripheral surface 18. The area where the fuel is adhered, that is, the area of the inner peripheral surface 18 exposed to the combustion chamber 12 without being covered with the piston 14 during the fuel injection is determined by the fuel injection timing AINUJ. Assuming that the injection is performed at the intake stroke, the area where the fuel is adhered increases as the fuel injection timing AINJ is set closer to the retarded side. As a result, the quantity of the fuel adhered to the inner peripheral surface 18 of the cylinder is increased as the fuel injection timing AINJ is set closer to the retarded side.

Adhesion of the fuel to the inner peripheral surface 18 may hinder promotion of atomization of the injected fuel. The aforementioned tendency becomes further noticeable if the particle size of the fuel is increased. The degree of atomization greatly depends on temperatures of the combustion chamber 12 and the fuel at a constant fuel injection pressure. Further those temperatures of the combustion chamber 12 and the fuel are correlated with the cooling water temperature THW. Therefore, if the cooling water temperature THW becomes lower, the fuel atomization is not promoted, thus increasing the quantity of the fuel adhered to the inner peripheral surface 18.

In the system according to this embodiment, the fuel injection quantity AINJ, fuel injection timing AINJ, and cooling water temperature THW are selected as parameters correlating with the quantity of the fuel adhered to the inner peripheral surface 18 of the cylinder.

Referring to the flowchart in FIG. 11, after the quantity of the fuel ΔFD mixed with the lubricating oil is calculated in step S700, the process proceeds to step S710. In step S710, the evaporative fuel quantity ΔFV per unit time, that is, the quantity of the fuel evaporating from the lubricating oil in the time interval T, is calculated using the equation (6). The evaporated fuel quantity ΔFV corresponds to the rate of decrease in the dilution degree when the dilution through the fuel injection is not considered.

$$\Delta FV \leftarrow g(THWST, QINJSUM) \quad (6)$$

where g( ) serves as a function for obtaining the quantity of the evaporative fuel ΔFV at the time interval T using the water temperature THWST at start of the engine, and the sum of the fuel injection quantity QINJSUM at start of the engine as parameters. The value THWST is used for estimating the initial temperature of the lubricating oil at the start of the engine. The value QINJSUM is used for estimating the increase in the lubricating oil temperature. The function g( ) is experimentally obtained in advance and stored in the memory 52 of the ECU 50 as a function map. The basic features of the function map will be explained.

The value of the function g( ) is increased as (1) the water temperature THWST becomes higher, and (2) the QINJSUM becomes larger. After calculating the ΔFD per unit time and the evaporative fuel quantity ΔFV in step S700 and step S710, the process proceeds to step S720 where the fuel dilution degree FDSUM is calculated using an equation (7) below.

$$FDSUM \leftarrow FDSUM+\Delta FD-\Delta FV \quad (7)$$

As the equation (7) indicates, the current dilution degree FDSUM is updated on the basis of the ΔFD, i.e., rate of increase in the dilution degree FDSUM, and the ΔFV, i.e., rate of decrease in the dilution degree FDSUM. The updated value is learned as the new dilution degree FDSUM and stored in the memory 52 of the ECU 50.

The process then proceeds to step S730 where comparison between the dilution degree FDSUM and a reference value FDSUMH is performed. If YES is obtained in step S730, that is, the FDSUM is equal to or larger than the FDSUMH, it is determined that the dilution degree is increasing. It may be determined that, if the dilution proceeds, increase in the dilution degree reaches the level where adverse influence of the dilution to the purge control, that is, deterioration in reliability of learning of purge concentration cannot be negligible. Then the flag XS indicating occurrence of the dilution is set to ON in step S740.

If NO is obtained in step S730, that is, the FDSUM is below the FDSUMH, the process proceeds to step S735 where comparison between the FDSUM and the FDSUML (<FDSUMH) is performed. If YES is obtained in step S735, that is, the FDSUM is equal to or smaller than the FDSUML, it is determined that the adverse influence of dilution to learning of purge concentration is negligible even if the dilution degree temporarily occurs to proceed dilution of the lubricating oil. The process then proceeds to step S745 where the flag XS indicating dilution of the lubricating oil is set to OFF.

After operation of the flag XS in step S740 or step S745, or NO is obtained in step S730 and step S735, the routine ends.

According to the process for determining conditions for inhibiting execution of purging shown in the flowchart of FIG. 10, it is determined whether the condition (1), that is flag XS is set to ON is established in step S600 using the aforementioned flag XS operated through calculation of the fuel dilution degree. The system of this embodiment is the same as that of the first embodiment in this respect.

The system for executing purging control according to the aforementioned embodiment provides the advantageous effects in addition to those advantageous effect (1) and (2) as described in the first embodiment.

(6) The rate of increase in the dilution degree FDSUM (dilution quantity per unit time) ΔFD is calculated on the basis of a parameter correlating with the quantity of the fuel adhered to the inner peripheral surface 18 of the cylinder at a predetermined time interval T. The current dilution degree FDSUM is updated on the basis of the calculated rate of increase ΔFD, and the updated value is learned as the new dilution degree FDSUM. This makes it possible to ensure accurate estimation of the fuel dilution degree FDSUM as the increase thereof as well as to enhance the aforementioned advantageous effects (1) and (2).

(7) The rate of decrease in the dilution degree FDSUM (quantity of evaporative fuel per unit time) ΔFV is calculated on the basis of the water temperature THWST at start of the engine, and the lubricating oil temperature estimated using the sum of fuel injection quantity QINJSUM after start of the engine as well as the rate of increase in the dilution degree FDSUM (quantity of fuel mixed with the lubricating oil per unit time) ΔFD. The aforementioned dilution degree FDSUM is updated and learned on the basis of both the rate of increase in dilution degree ΔFD and the rate of decrease in dilution degree ΔFV. As a result, both the increase and decrease in the dilution degree FDSUM can be further estimated accurately.

(8) Estimation of the dilution degree FDSUM may be ensured by selecting at least one of the fuel injection quantity, fuel injection timing, and temperature of the engine as a parameter correlating with the quantity of the fuel adhered to the inner peripheral surface 18 of the cylinder. This makes it possible to further ensure accurate estimation of the dilution degree FDSUM. Third embodiment A third embodiment of the invention will be described hereinafter. This embodiment is different from the first embodiment in the procedure as executed in step S600 of the flowchart of the routine for determining the condition for inhibiting execution of purging as shown in FIG. 10. More specifically, the procedure for determining whether the variance of the actual A/F ratio with respect to the theoretical A/F ratio owing to dilution is different from that of the first embodiment.

In the first embodiment, the operation history of the internal combustion engine 10 under the condition where the dilution degree is increasing, that is, history of the cold short-trip is monitored. It is estimated that the dilution degree is increased to a high level on the basis of the monitored results. Meanwhile in the third embodiment, comparison of the A/F ratio learned values KGi between the high load region and the low load region is performed. If there is a variance between those A/F ratio learned values KGi, it is estimated that the dilution degree is increased to a high level.

In the third embodiment, the condition (1) used for execution of step S600 of the flowchart shown in FIG. 10 is changed to |KG5−KG1 |>JKG; where KG5 indicates the A/F ratio learned value KGi in the region R5 at the highest load side; KG1 indicates the A/F ratio learned value KGi in the region R1 at the lowest load side; and JKG indicates the reference value that shows a large variance between the respective A/F ratio learned values KG1 and KG5.

When the fuel evaporates from the lubricating oil, the rate of change in quantity of the evaporative fuel may be substantially low. Therefore, the variance tendency between the actual and target A/F ratios on the steady basis is reflected on the A/F ratio learned value KGi.

The quantity of the fuel injected from the fuel injection valve 20 becomes relatively small during engine operation at low load. Therefore, when the fuel evaporates from the lubricating oil, the ratio of the evaporative fuel quantity to the whole quantity of the fuel supplied to the internal combustion engine 10 becomes larger than the ratio obtained during the engine operation at high load. The A/F ratio learned value KG1 in the engine operation at low load is susceptible to the evaporative fuel and different from the A/F ratio learned value KG5 in the engine operation at high load with respect to the variance tendency.

Accordingly, if the respective variance tendency of the KG1 and KG5 are monitored using the aforementioned condition |KG5−KG1 |>JKG, increase in the quantity of the evaporative fuel from the lubricating oil can be accurately determined so as to inhibit execution of purging. In this embodiment, therefore, the advantageous effects that are the same as those (1) and (2) described in the first embodiment can also be obtained.

The system described in the respective embodiments may be partly modified as described below.

In the aforementioned embodiments, the purging operation is inhibited upon establishment of the condition that the A/F ratio correction amount FAFKGi is equal to or smaller than the reference value. However, the purging operation may be inhibited only when the condition that the flag XS indicating occurrence of dilution is set to ON, or the condition that the variance between the A/F ratio learned values KG1 and KG5 is large (|KG5−KG1|>JKG) is established.

In the third embodiment, the large variance between the A/F ratio learned values in the engine operation at low load and high load is estimated on the basis of the difference between those values. However, the large variance between A/F ratio learned values may be estimated on the basis of the ratio of those values. Alternatively the A/F ratio learned value at the low load region R1 is estimated through extrapolation on the basis of the learned values KG3 to KG5 corresponding to the load regions R3 to R5 in the engine operation at high load. Then the variance may be estimated on the basis of comparison between the estimated and the actual A/F ratio learned values KG1.

In the process executed in step S160 shown in FIG. 3 according to the first embodiment, comparison between the cooling water temperature THW and the predetermined temperature THWH is performed so as to determine whether the quantity of fuel evaporating from the lubricating oil as a whole has increased to reach the predetermined quantity at the increasing average temperature of the lubricating oil. The evaporative fuel quantity, an initial value of the lubricating oil temperature is estimated on the basis of the water temperature THWST, and the increase in the temperature is estimated on the basis of the sum of the fuel injection quantity after start of the engine. It is noted that the sum of the fuel injection quantity may be replaced by the sum of the intake air quantity only when the uniform charge combustion is selected. Then, based on the lubricating oil temperature as the sum of the initial value and the increase in the temperature, the quantity of the evaporative fuel may be calculated more accurately.

In the first embodiment, it is determined whether the current engine operation corresponds to the cold short-trip upon establishment of the condition that the cooling water temperature THWST is equal to or lower than the predetermined temperature THWL, and the sum of the intake air quantity GASUM is equal to or smaller than the predetermined value GASUML. The aforementioned condition may be modified such that the water temperature THWST after start of the engine is equal to or lower than the predetermined temperature THWL and the engine operation time counted from its start to stop is equal to or smaller than a predetermined value.

In the first embodiment, the predetermined value GASUML to be compared with the sum of the intake air quantity GASUM may be variably set in accordance with the water temperature THWST. More specifically, it is preferable to set the predetermined value GASUML to be reduced as the increase in the water temperature THWST.

In the first embodiment, the counter value C is counted up by the predetermined amount a. It is possible to increase the predetermined amount a as the variance between the THWST and the THWL (for example, the deviation of THWL from TWHST) becomes large because the quantity of the fuel mixed with the lubricating oil is likely to increase as the variance becomes large. Likewise, the predetermined amount a may be increased as the variance between the sum of the intake air quantity GASUM and the predetermined value GASUML (for example, deviation of GASUML from GASUM) becomes large. It may be possible to variably set the predetermined value $\alpha$ on the basis of both the aforementioned variance values.

In the first embodiment, the counter value C is counted down by the predetermined amount $\beta$. It is possible to increase the predetermined amount $\beta$ as the variance between the THW and the THWH (for example, the deviation of THW from THWH) becomes large because the quantity of the fuel mixed with the lubricating oil is likely to increase as the variance becomes large.

In the first embodiment or modified example thereof, comparison between the sum of the intake air quantity GASUM after start of the engine and the predetermined value GASUML corresponding thereto is performed in order to determine whether the current engine operation corresponds to the cold short-trip. The sum of the intake air quantity GASUM after start of the engine may be replaced by the sum of the fuel injection quantity after start of the engine.

In the aforementioned embodiments, the A/F ratio correction amount FAFKGi is calculated in reference to the feedback correction coefficient FAF and the A/F ratio learned value KGi as shown in the equation (3). However, only the A/F ratio learned value KGi may be used for calculating the A/F ratio correction amount FAFKGi.

In the aforementioned embodiments, the dilution degree of the lubricating oil is estimated on the assumption that dilution of the lubricating oil and evaporation of the fuel from the lubricating oil occur only when the engine is operated. The dilution degree and fuel evaporation during the engine operation tend to be more than those obtained during stop of the engine. However, the fuel evaporation does occur even when the engine is in the stopped state. Therefore, the time during stop of the engine is counted and the lubricating oil temperature at start of the engine (or stop of the engine) is estimated. Based on the counted time and the estimated lubricating oil temperature, the quantity of the evaporative fuel may be estimated. Further accurate estimation of the dilution degree of the lubricating oil is ensured if the quantity of the evaporative fuel during stop of the engine is considered.

The combustion heat generated by the fuel injection may vary with the A/F ratio upon fuel injection and ignition timing as well as the intake air quantity, fuel injection quantity and the like. In the first embodiment, it is effective to consider the aforementioned A/F ratio and the intake timing for calculating the sum of the intake air quantity GASUM. Likewise, it is effective in the second embodiment to consider the aforementioned A/F ratio and the intake timing for calculating the sum of the fuel injection quantity QINJSUM. More specifically, each value of the GASUM and QINJSUM may be calculated by weighting of the A/F ratio, the ignition timing and the like so as to improve accuracy in estimation of the combustion heat and the lubricating oil temperature.

In the aforementioned embodiments, the lubricating oil temperature is estimated on the basis of the operating state of the engine, such as the cooling water temperature THW, the water temperature THWST at start of the engine, the sum of fuel injection quantity QINJSUM after start of the engine, and the like. Alternatively, a sensor for directly detecting the lubricating oil temperature may be provided such that various kinds of control is performed on the basis of the detected lubricating oil temperature. In this case, it is preferable to detect the lubricating oil temperature within the oil pan 74, or the lubricating oil temperature that highly correlates with the average temperature of the lubricating oil as a whole.

What is claimed is:

1. An evaporative fuel processing system for an in-cylinder injection type internal combustion engine comprising:

an evaporative fuel processing mechanism that includes a canister to which an evaporative fuel in a fuel supply system is adsorbed and performs an operation for purging the adsorbed evaporative fuel into an intake system of the internal combustion engine; and a controller that:

estimates a degree of dilution occurred in a lubricating oil for the internal combustion engine with a fuel mixed therewith; and inhibits the purging operation performed by the evaporative fuel processing mechanism when the estimated degree of dilution is equal to or larger than a predetermined value.

2. The evaporative fuel processing system according to claim 1, wherein the controller inhibits the purging operation when the estimated degree of dilution is equal to or larger than the predetermined value, and an air/fuel ratio correction amount of an air/fuel ratio feedback control obtained in accordance with a variance tendency of an actual air/fuel ratio with respect to a target air/fuel ratio increases by a predetermined amount or more so as to compensate the actual air/fuel ratio to a fuel rich side with respect to the target air/fuel ratio.

3. The evaporative fuel processing system according to claim 1, wherein the controller estimates the degree of dilution on the basis of a historical record of an operation of the internal combustion engine.

4. The evaporative fuel processing system according to claim 3, wherein the controller monitors the operation of the internal combustion engine in a state where the degree of dilution is increasing and estimates the degree of dilution on the basis of a result of monitoring the operation.

5. The evaporative fuel processing system according to claim 4, wherein the controller estimates a total quantity of combustion heat generated in a cylinder from start to stop of the internal combustion engine on the basis thereof, and determines that the internal combustion engine is operated in the state where the degree of dilution is increasing when a temperature of the engine at the start is equal to or lower than a predetermined temperature, and the estimated total quantity of the combustion heat is equal to or smaller than a predetermined quantity.

6. The evaporative fuel processing system according to claim 5, wherein the controller determines that the total quantity of the combustion heat is equal to or smaller than the predetermined quantity when one of a sum of intake air quantity and a sum of fuel injection quantity obtained from the start to stop of the internal combustion engine is equal to or smaller than a predetermined value.

7. The evaporative fuel processing system according to claim 4, wherein the controller determines whether the degree of dilution is increasing on the basis of one of a lubricating oil temperature and a parameter correlating therewith, and estimates the degree of dilution on the basis of a counter value which is increased when it is determined that the internal combustion engine is operated in the state where the degree of dilution is increasing, and gradually decreased when it is determined that the internal combustion engine is operated in the state where the degree of dilution is decreasing.

8. The evaporative fuel processing system according to claim 1, wherein the controller calculates a rate of increase in the degree of dilution on the basis of a parameter correlating with quantity of the fuel adhered to an inner peripheral surface of a cylinder of the internal combustion engine during fuel injection; and estimates the degree of dilution so as to be updated on the basis of the calculated rate of increase.

9. The evaporative fuel processing system according to claim 8, wherein the controller calculates the rate of increase in the degree of dilution using a parameter correlating with the quantity of the fuel adhered to the inner peripheral surface of the cylinder, which includes at least one of fuel injection quantity, fuel injection timing, and a temperature of the internal combustion engine.

10. The evaporative fuel processing system according to claim 8, wherein the controller further estimates quantity of the fuel evaporating from the lubricating oil on the basis of one of a lubricating oil temperature and a parameter correlating therewith, calculates a rate of decrease in the degree of dilution on the basis of the estimated quantity of the fuel, and learns the degree of dilution so as to be updated on the basis of the calculated rates of increase and decrease.

11. The evaporative fuel processing system according to claim 1, wherein the controller inhibits the purging operation when the engine is operated in a low load state.

12. An evaporative fuel processing system for an in-cylinder injection type internal combustion engine comprising:

an evaporative fuel processing mechanism that includes a canister to which an evaporative fuel in a fuel supply system is adsorbed and performs an operation of purging of the adsorbed evaporative fuel into an intake system of the internal combustion engine; and a controller that obtains a plurality of air/fuel ratio learned values corresponding to a plurality of engine load regions, each of which is used for compensating a variance tendency of an actual air/fuel ratio with respect to a target air/fuel ratio on a steady basis, and inhibits the purging operation performed by the evaporative fuel processing mechanism when a value representative of a variance of a first air/fuel ratio learned value corresponding to a highest engine load region among the plurality of engine load regions with respect to a second air/fuel ratio learned value corresponding to a lowest engine load region is equal to or larger than a predetermined value.

13. The evaporative fuel processing system according to claim 12, wherein the controller inhibits the purging operation when the value representative of the variance tendency is equal to or larger than the predetermined value, and an air/fuel ratio correction amount of an air/fuel ratio feedback control obtained in accordance with a variance tendency of an actual air/fuel ratio with respect to a target air/fuel ratio increases by a predetermined amount or more so as to compensate the actual air/fuel ratio to a fuel rich side with respect to the target air/fuel ratio.

14. The evaporative fuel processing system according to claim 12, wherein the controller inhibits the purging operation when the engine is operated in a low load state.

15. An evaporative fuel processing method for an in-cylinder injection type internal combustion engine provided with an evaporative fuel processing mechanism that includes a canister to which an evaporative fuel in a fuel supply system is adsorbed and performs an operation for purging the adsorbed evaporative fuel into an intake system of the internal combustion engine, the evaporative fuel processing method comprising:

estimating a degree of dilution occurred in a lubricating oil for the internal combustion engine with a fuel mixed therewith; and inhibiting the purging operation performed by the evaporative fuel processing mechanism when the estimated degree of dilution is equal to or larger than a predetermined value.

16. The method according to claim 15, wherein a rate of increase in the degree of dilution is calculated on the basis of a parameter correlating with quantity of the fuel adhered to an inner peripheral surface of a cylinder of the internal combustion engine during fuel injection; and estimates the degree of dilution so as to be updated on the basis of the calculated rate of increase.

17. The method according to claim 15, wherein the purging operation is inhibited when the engine is operated in a low load state.

18. An evaporative fuel processing method for an in-cylinder injection type internal combustion engine provided with an evaporative fuel processing mechanism that includes a canister to which an evaporative fuel in a fuel supply system is adsorbed and performs an operation for purging the adsorbed evaporative fuel into an intake system of the internal combustion engine, the evaporative fuel processing method comprising:

obtaining a plurality of air/fuel ratio learned values corresponding to a plurality of engine load regions, each of which is used for compensating a variance tendency of an actual air/fuel ratio with respect to a target air/fuel ratio on a steady basis, and inhibiting the purging operation performed by the evaporative fuel processing mechanism when a value representative of a variance of a first air/fuel ratio learned value corresponding to a highest engine load region among the plurality of engine load regions with respect to a second air/fuel ratio learned value corresponding to a lowest engine load region is equal to or larger than a predetermined value.

19. The method according to claim 18, wherein the purging operation is inhibited when the engine is operated in a low load state.

* * * * *